US007065316B2

(12) United States Patent
Yanagida et al.

(10) Patent No.: US 7,065,316 B2
(45) Date of Patent: Jun. 20, 2006

(54) CLEANING UNIT, PROCESS CARTRIDGE, IMAGE FORMING APPARATUS, AND TONER

(75) Inventors: Masato Yanagida, Tokyo (JP); Atsushi Sampe, Kanagawa (JP); Naohiro Kumagai, Kanagawa (JP); Toshio Koike, Kanagawa (JP); Takeshi Shintani, Kanagawa (JP); Masanori Kawasumi, Kanagawa (JP); Masami Tomita, Shizuoka (JP); Eisaku Murakami, Kanagawa (JP); Takeshi Uchitani, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 302 days.

(21) Appl. No.: 10/668,498

(22) Filed: Sep. 24, 2003

(65) Prior Publication Data

US 2004/0141779 A1 Jul. 22, 2004

(30) Foreign Application Priority Data

Sep. 24, 2002 (JP) ..... 2002-276748
Oct. 29, 2002 (JP) ..... 2002-314241

(51) Int. Cl.
*G03G 21/00* (2006.01)

(52) U.S. Cl. ..... 399/350; 399/123

(58) Field of Classification Search ..... 399/343, 399/346, 350, 351, 111, 123; 430/58.05, 430/111.4, 11.4; 15/1.51, 256.51, 256.52, 15/256.53

See application file for complete search history.

(56) References Cited

U.S. PATENT DOCUMENTS

| | | | | |
|---|---|---|---|---|
| 5,239,350 | A * | 8/1993 | Godlove | 399/34 |
| 5,328,792 | A * | 7/1994 | Shigemori et al. | 430/110.3 |
| 5,521,691 | A * | 5/1996 | Morimoto et al. | 399/350 |
| 5,565,961 | A | 10/1996 | Shoji et al. | |
| 6,002,911 | A | 12/1999 | Suzuki et al. | |
| 6,103,441 | A | 8/2000 | Tomita et al. | |
| 6,128,462 | A * | 10/2000 | Kato et al. | 399/350 |
| 6,187,489 | B1 * | 2/2001 | Oishi et al. | 430/45 |
| 6,363,229 | B1 | 3/2002 | Shiraishi et al. | |
| 6,403,270 | B1 * | 6/2002 | Itami et al. | 430/59.5 |
| 6,444,387 | B1 * | 9/2002 | Ri et al. | 430/67 |
| 6,539,189 | B1 | 3/2003 | Yanagida | |
| 6,558,861 | B1 * | 5/2003 | Ito et al. | 430/47 |
| 6,600,887 | B1 * | 7/2003 | Takami et al. | 399/174 |

(Continued)

FOREIGN PATENT DOCUMENTS

EP 0 622 709 A2 11/1994

(Continued)

OTHER PUBLICATIONS

Ronald E. Godlove, "Charged Self Lubricating Cleaning Blade", Xerox Disclosure Journal, vol. 19, No. 2, XP-000435049, Mar. 1, 1994, pp. 145-147.

*Primary Examiner*—Hoan Tran
(74) *Attorney, Agent, or Firm*—Oblon, Spivak, McClelland, Maier & Neustadt, P.C.

(57) ABSTRACT

A cleaning unit is equipped with a cleaning blade that is in contact with a surface of a photosensitive drum and cleans the surface. A peak temperature of a loss tangent (tan δ) is in a range of 2° C. to −30° C. when a sine-wave vibration of 10 Hz is applied to the cleaning blade. Moreover, the cleaning unit lowers a coefficient of static friction of the surface of the photosensitive drum that is to be cleaned.

42 Claims, 7 Drawing Sheets

U.S. PATENT DOCUMENTS

| | | | | |
|---|---|---|---|---|
| 6,694,122 | B1 * | 2/2004 | Muto et al. | 399/350 |
| 6,701,123 | B1 * | 3/2004 | Endo et al. | 399/350 |
| 6,787,280 | B1 * | 9/2004 | Yamashita et al. | 430/111.4 |

FOREIGN PATENT DOCUMENTS

| | | |
|---|---|---|
| EP | 1 245 602 A1 | 10/2002 |
| JP | 2-284191 | 11/1990 |
| JP | 3-4291 | 1/1991 |
| JP | 5-188637 | 7/1993 |
| JP | 6-282108 | 10/1994 |
| JP | 7-172856 | 7/1995 |
| JP | 8-166749 | 6/1996 |
| JP | 8-262880 | 10/1996 |
| JP | 8-262881 | 10/1996 |
| JP | 8-297451 | 11/1996 |
| JP | 8-328287 | 12/1996 |
| JP | 2000-019918 | 1/2000 |
| JP | 2000-19918 | 1/2000 |
| JP | 2000-112315 | 4/2000 |
| JP | 2000-122347 | 4/2000 |
| JP | 2001-290404 | 10/2001 |
| JP | 2002-55480 | 2/2002 |
| JP | 2002-072804 | 3/2002 |
| JP | 2002-214820 | 7/2002 |
| JP | 2002-214992 | 7/2002 |
| JP | 2002-236438 | 8/2002 |
| JP | 2002-268490 | 9/2002 |
| JP | 2002-268492 | 9/2002 |
| JP | 2002-268494 | 9/2002 |

* cited by examiner

CLEANING UNIT, PROCESS CARTRIDGE, IMAGE FORMING APPARATUS, AND TONER

BACKGROUND OF THE INVENTION

1) Field of the Invention

The present invention relates to a cleaning unit, a process cartridge equipped with the cleaning unit, an image forming apparatus, and a toner used in the image forming apparatus.

2) Description of the Related Art

Image forming process in electrophotography includes steps of charging a surface of a photosensitive drum, forming an electrostatic latent image on the surface of the photosensitive drum, developing the electrostatic latent image with toner to form a toner image, transferring the toner image to an intermediate transfer belt, transferring the toner image from the intermediate transfer belt to a recording medium or transferring the toner image on the photosensitive drum directly to the recording medium, and forming the image on the recording medium by fixing the toner with a hot roll. Some of the toner that is not transferred to the intermediate transfer belt or the recording medium remains on the surface of the photosensitive drum after having transferred the toner image. In addition, paper dust, additive component in the toner, etc. are deposited on the surface of the photosensitive drum. In General, a cleaning unit cleans all those foreign matter including the remained toner, etc. before proceeding to the next image forming process. The cleaning unit typically includes a blade, a brush, and a magnetic brush. Scraping the remaining toner off on the photosensitive drum by using a cleaning blade made of an elastic material is a generally accepted way of cleaning because of low cost and stable efficiency.

On the other hand, with an advancement of a digital technology, a digital image forming has gained a popularity. Particularly, in a color image forming apparatus, a highly defined image output by reproducing a small dot of one pixel is commonly demanded. To meet the demand for the highly defined image, reducing a particle size, improving a spherical shape of particles have been studied as a part of improvement in toner. Reproducibility of a dot is improved by reducing the particle size. Developing and transferring is enhanced by employing the spherical shape of particles.

However, if a toner having a small particle size with the spherical shape is used, the surface of the photosensitive drum cannot be cleaned properly with the cleaning blade after having transferred the toner image. This is because it is difficult to overcome adhesive power of toner on the photosensitive drum due to the small particle size. Moreover, due to the spherical particles in the toner, the toner tends to rotates between the cleaning blade and the photosensitive drum thereby slipping through the gap.

If a pressure under which the cleaning blade is in contact with the photosensitive drum is increased to clean the toner having a small particle size with the spherical shape, with increased force of friction, it results in bending or chattering of the blade, thereby affecting the cleaning of the photosensitive drum.

The temperature dependency is one of the mechanical properties of the cleaning blade. In a wide range of temperatures under which the image forming apparatus is used, particularly, at low temperatures, the scraping capacity of the cleaning blade with respect to the photosensitive drum is deteriorated, thereby causing slipping of the toner on the surface of the photosensitive drum.

The following measures are proposed for cleaning the photosensitive drum when the toner having a small particle size with the spherical shape is used.

In the image forming apparatus disclosed in Japanese Patent Application Laid Open Publication No. 2002-268490, a polymer toner has an average particle size in a range of 3 micrometers to 8 micrometers, a variation coefficient in a particle size distribution not more than 27 percent, and proportion of toner particles in a range of shape factor from 0.940 to 0.985. Material for cleaning blade in the cleaning unit is polyurethane rubber having JIS rubber hardness in a range of 65 to 73 degrees in an environment of 25° C., 300 percent modulus 980×104 Pascal, an impact resilience in a range of 40 percent to 73 percent, and the cleaning blade in contact is exerting load in a range of 147 mN/cm to 147 mN/cm on the photosensitive drum.

Moreover, in the cleaning unit disclosed in Japanese Patent Application Laid Open Publication No. 2002-214992, a cleaning blade having the impact resilience H fulfilling the condition $45 \leqq H < 70$ (percent) is allowed to be in contact with a cylindrical photosensitive drum at an angle not more than central angle of cylinder $\beta \pm 30$ degrees.

Furthermore, in the image forming apparatus disclosed in Japanese Patent Application Laid Open Publication No. 2002-72804, a toner prepared by adding an external additive having an average particle size in a range of 50 micrometers to 500 micrometers to toner particles having an average shape index SF in a range of 100 to 135 is used. A cleaning blade of the cleaning unit is made of an elastic material having an impact resilience not les than 35 percent at 10° C.

Moreover, an additive like fine particles of resin or a metal oxide, a metal nitride, and metal carbide of silica, titania, alumina etc. are added to the toner to adjust fluidity and charging characteristics of the toner. However, if the particles are made smaller, the surface area of a unit weight of toner becomes large and the quantity of the additive increases in accordance with the surface area. Due to the increase in the quantity of the additive to be added, the quantity of the additive that is separated (free) increases and the additive remains on an image carrier instead of being transferred together with the toner or being cleaned from the image carrier. Since the remained additive is insulating in nature electrically, it is charged by a charging unit and adheres firmly on the photosensitive drum. With this additive of silica etc. adhered as a base, the other ingredients of toner like a binder resin, a mold releasing agent etc. are adhered and deposited. This deposition of silica etc. on the photosensitive drum causes a faulty image with a white patch on a half tone or a beta image in negative-positive developing in digital developing.

In Japanese Patent Application Laid Open Publication No. 2000-19918 an image forming apparatus provided with two cleaning units where a peak temperature of tan δ of a cleaning blade in the second cleaning unit is adjusted in a range of 2° C. to 15° C. to deal with improper cleaning caused by almost spherical-shaped particles of toner due to polymerization process, is proposed. In Japanese Patent Application Laid Open Publication No. 2000-112315, a rubber member used in electrophotography made of an elastic rubber having a peak temperature of tan δ in a range of −10° C. to 20° C. and half power bandwidth not less than 30° C. is proposed. Moreover, in Japanese Patent Application Laid Open Publication No. 2001-290404, a cleaning blade made of urethane having a peak temperature of tan δ not less than 10° C. and not more than 30° C. is proposed.

Although the image forming apparatuses are used in wide range of environmental conditions from high temperature to low temperature, due to the temperature dependency, which is one of the mechanical properties of the cleaning blade, the cleaning blade resonates at a high temperature causing noise and chatters at a low temperature causing vibrations. Moreover, at a low temperature, due to deterioration of scraping of the photosensitive drum, the toner slips on the surface of the photosensitive drum. While using a toner having a small particle size with the spherical shape, the slipping of toner doesn't allow proper cleaning of the surface of the photosensitive drum. If the frictional force between the photosensitive drum and the cleaning blade is increased to achieve better cleaning, it results in bending or chattering of the blade, thereby affecting the cleaning of the photosensitive drum. Furthermore, in a toner having a small particle size, the increased amount of the external additive gives rise to image defects initiated from silica etc.

SUMMARY OF THE INVENTION

It is an object of the present invention to solve at least the problems in the conventional technology.

The cleaning unit according to one aspect of the present invention includes a cleaning blade that cleans a surface of a photosensitive drum, wherein when a sine-wave vibration of 10 Hz is applied to the cleaning blade, a peak temperature of a loss tangent tan δ is in a range of 2° C. to −30° C.

The process cartridge according to another aspect of the present invention includes an arrangement that includes at least a cleaning unit that cleans residual toner on a photosensitive drum, and that is detachably mounted on an image forming apparatus, wherein the cleaning unit includes a cleaning blade that is in contact with a surface of the photosensitive drum to clean the surface, and when a sine-wave vibration of 10 Hz is applied to the cleaning blade, a peak temperature of a loss tangent tan δ is in a range of 2° C. to −30° C.

The image forming apparatus according to still another aspect of the present invention includes a photosensitive drum on which an electrostatic latent image is formed, a charging unit that charges the photosensitive drum, an exposing unit that exposes a surface of the photosensitive drum to form the electrostatic latent image, a developing unit that supplies toner to the surface of the photosensitive drum to form a toner image, a transferring unit that includes either of a transferring member and an intermediate transfer element to transfer the toner image to a recording medium, and a cleaning unit that includes a cleaning blade that cleans the surface of the photosensitive drum, wherein when a sine-wave vibration of 10 Hz is applied to the cleaning blade, a peak temperature of a loss tangent tan δ is in a range of 2° C. to −30° C.

The cleaning unit according to still another aspect of the present invention includes a cleaning blade that cleans a surface of a photosensitive drum, wherein an impact resilience of the cleaning blade at 10° C. is equal to or more than 35 percent, and a rate of change of the impact resilience in a temperature range of 10° C. to 40° C. is equal to or less than 1.4/° C.

The process cartridge according to still another aspect of the present invention includes an arrangement that includes at least a cleaning unit that cleans residual toner on a photosensitive drum, and that is detachably mounted on an image forming apparatus, wherein the cleaning unit includes a cleaning blade that is in contact with a surface of the photosensitive drum to clean the surface, an impact resilience of the cleaning blade at 10° C. is equal to or more than 35 percent, and a rate of change of the impact resilience in a temperature range of 10° C. to 40° C. is equal to or less than 1.4/° C.

The image forming apparatus according to still another aspect of the present invention includes a photosensitive drum on which an electrostatic latent image is formed, a charging unit that charges the photosensitive drum, an exposing unit that exposes a surface of the photosensitive drum to form the electrostatic latent image, a developing unit that supplies toner to the surface of the photosensitive drum to form a toner image, a transferring unit that has either a transferring member or an intermediate transfer element, and transfers the toner image to a surface of a recording medium, and a cleaning unit that includes a cleaning blade that cleans the surface of the photosensitive drum, wherein an impact resilience of the cleaning blade at 10° C. is equal to or more than 35 percent, and a rate of change of the impact resilience in a temperature range of 10° C. to 40° C. is equal to or less than 1.4/° C.

The toner according to still another aspect of the present invention, which is used for developing in electrophotography, has a volume average particle size in a range of 3 micrometers to 8 micrometers, and a ratio of the volume average particle size and a number average particle size Dv/Dn in a range of 1.00 to 1.40.

The toner according to still another aspect of the present invention, which is used for developing in electrophotography, has a shape factor SF-1 in a range of 100 to 180, and a shape factor SF-2 in a range of 100 to 180.

The other objects, features and advantages of the present invention are specifically set forth in or will become apparent from the following detailed descriptions of the invention when read in conjunction with the accompanying drawings.

DETAILED DESCRIPTION

Exemplary embodiments of a method of planning, a cleaning unit, a process cartridge, an image forming apparatus, and a toner according to the present invention are explained in detail with reference to the accompanying drawings.

Figure 1:
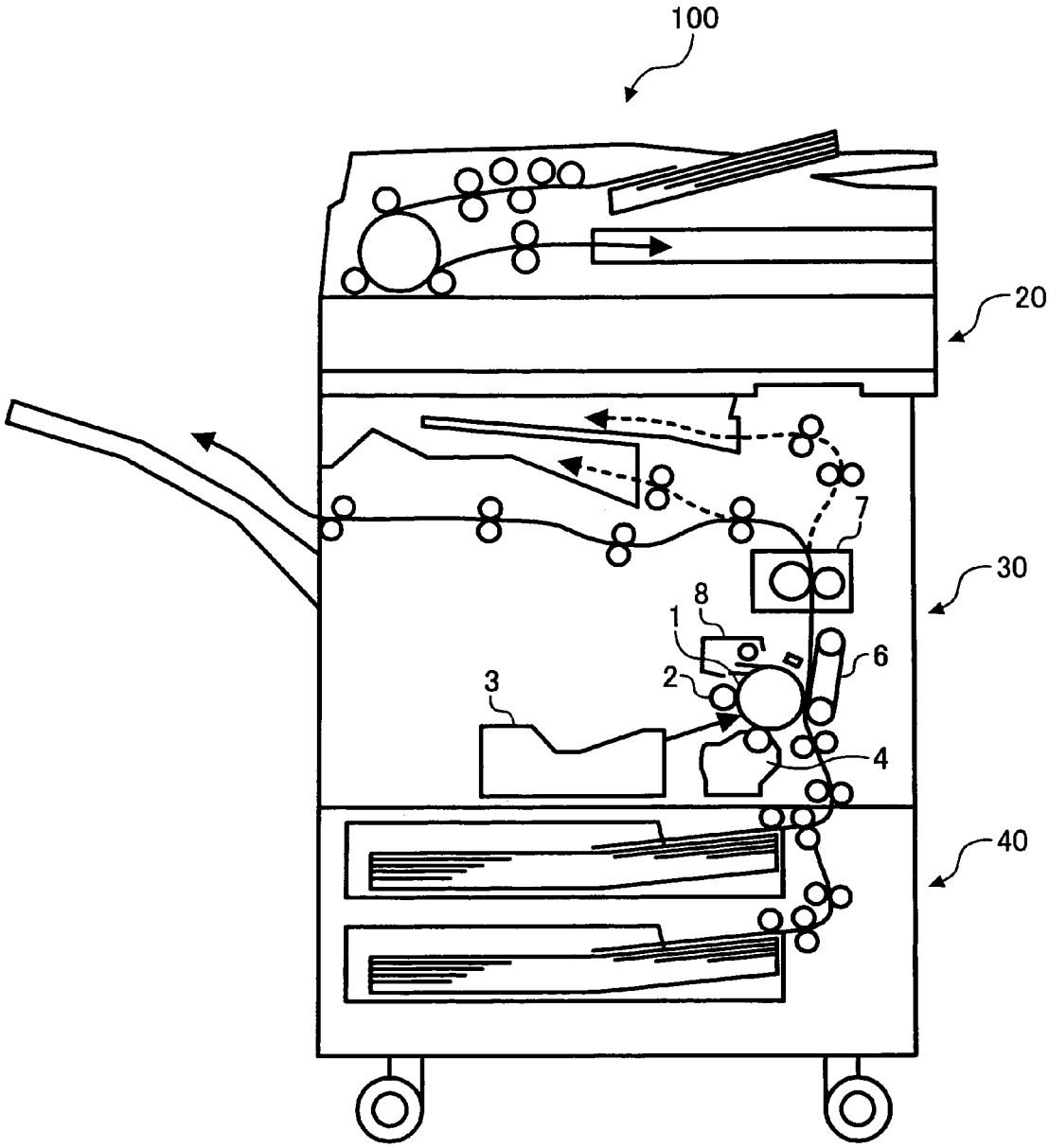
FIG. 1 is a schematic diagram of an image forming apparatus equipped with a cleaning unit according to a first embodiment and a second embodiment of the present invention.
Figure 2:
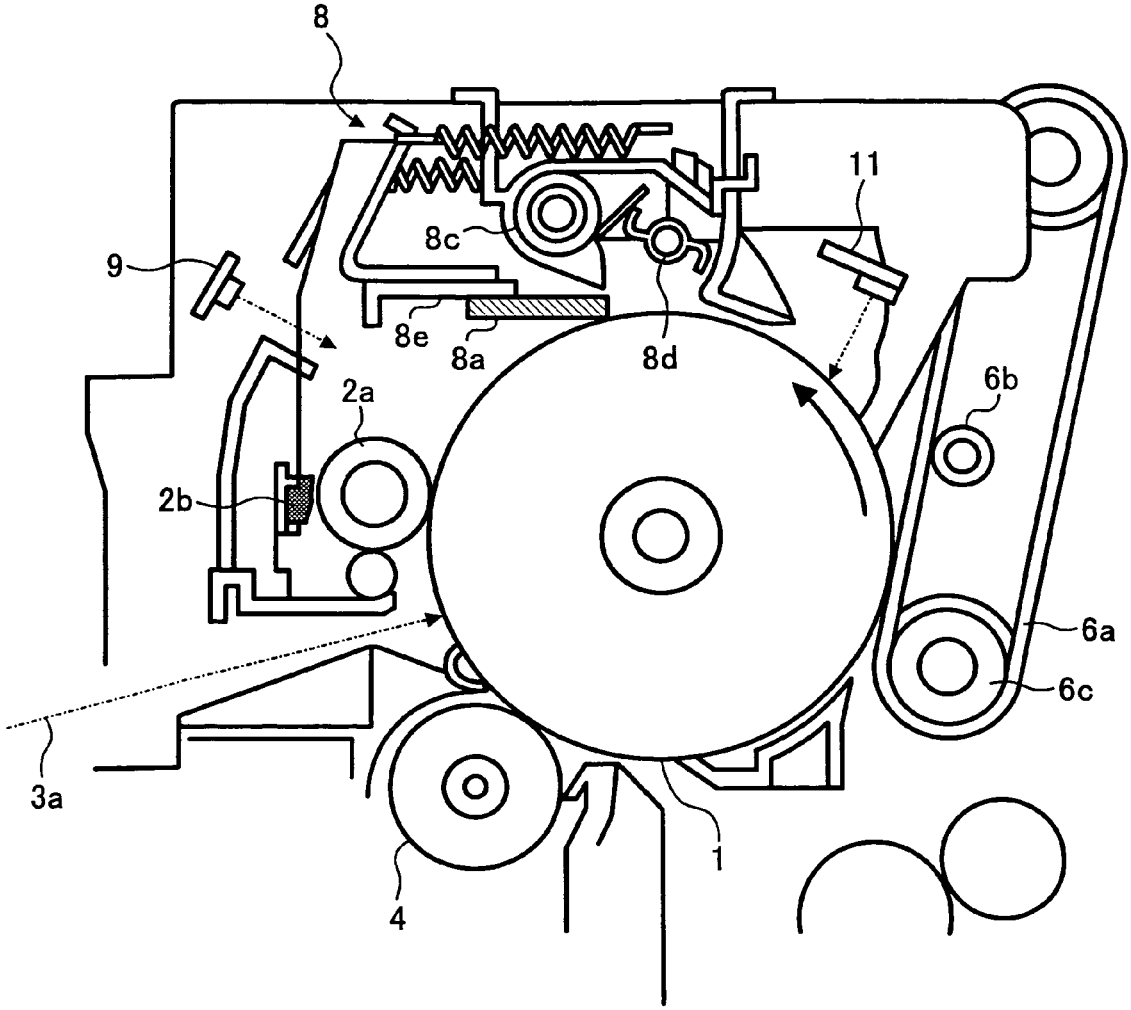
FIG. 2 is a schematic diagram of a periphery of a photosensitive drum of the image forming apparatus according to the first embodiment and the second embodiment.

FIG. 1 is a schematic diagram of an image forming apparatus equipped with a cleaning unit according to a first embodiment of the present invention. FIG. 2 is a schematic diagram around periphery of a photosensitive drum of the image forming apparatus equipped with the cleaning unit in the present invention.

A charging unit 2, an exposing unit 3, a developing unit 4, a transferring unit 6, a fixing unit 7, and a cleaning unit 8 are disposed around the periphery of a photosensitive drum 1, which is an electrostatic latent image carrier.

An organic compound like bisazo pigments and phthalocyanine pigments, an amorphous metal like amorphous silicone, amorphous selenium which are photoconductive, can be used for the photosensitive drum 1. Taking into consideration the environment and disposal after use, it is desirable to use a photosensitive drum having an organic compound.

The charging unit 2 may be employing any one of a corona charging, a roller charging, a brush charging, and a blade charging. The charging unit 2 in this embodiment is a roller charging unit. The charging unit 2 includes a charging roller 2*a*, a cleaning pad 2*b* that is in contact with the charging roller 2*a* for the purpose of cleaning, and a power supply that is in contact with the charging roller 2*a* but is not shown in the figure. A high voltage is applied on the charging roller 2*a* thereby applying a prescribed voltage between the photosensitive drum 1 and the charging roller 2*a* having curvature. Corona discharge is generated between the photosensitive drum 1 and the charging roller 2*a*, thereby charging a surface of the photosensitive drum 1 uniformly.

The exposing unit 3 converts data that is read by a scanner of a reading unit and an image signal transmitted from outside like from a PC, which is not shown in the diagram, allows to scan a laser beam 3 by a polygon motor, and forms an electrostatic latent image on the photosensitive drum 1 based on the image signal that is read through a mirror.

The developing unit 4 includes a developer carrier that carries a developer to the photosensitive drum 1 and a toner supplying chamber. It includes a cylindrical developer carrier that is disposed in a position such that it maintains a minute gap from the photosensitive drum and a developer regulator that regulates the amount of the developer on the developer carrier. The developer carrier includes a hollow developer cylinder that is rotatably supported inside the developer carrier and a magnet roll that is fixed to the same shaft inside the hollow developer cylinder. A developer adheres magnetically on an outer peripheral surface of a hollow developer cylinder and is carried further. The hollow developer cylinder is formed by a photoconductive and non-magnetic material. A power supply for applying of developing bias is connected to this hollow developer cylinder. The voltage is applied between the hollow developer cylinder and the photosensitive drum 1 by the power supply, thereby forming an electric field in an area of developing.

The transferring unit includes a transfer belt 6*a*, a transfer bias roller 6*b* and a tension roller 6*c*. The transfer bias roller 6*b* includes a core of iron, aluminum, and stainless etc. with an elastic layer (a layer of an elastic material) on its surface. To keep a paper in a close contact with the photosensitive drum 1, a pressure necessary on the side of the photosensitive drum 1 is applied on the transfer bias roller 6*b*. Effectiveness of the transfer belt 6*a* depends on a heat resistant material that is selected as a base material of the belt. The transfer belt 6*a* can be made of a seamless polyimide film on an outer surface of which a layer of fluorine-contained resin can be applied. Moreover, if it is necessary, a layer of silicone rubber may be provided on the polyimide film on which a layer of fluorine-contained resin can also be applied. A tension roller is provided on an inner side of the transfer belt 6*a* to drive the belt and to apply tension in the belt.

The fixing unit 7 includes a fixing roller having a heater for heating a halogen lamp and a pressurizing roller that is in pressed contact. The fixing roller includes a core with an elastic layer (a layer of an elastic material) of 100 micrometers to 500 micrometers thickness, desirably of 400 micrometers thickness on it and an outer layer of a resin having good mold releasing property like that of a fluorine contained resin, to prevent adhesion of toner due to its viscosity. The outer resin layer is formed by a PFA tube. A temperature detector is provided on an outer peripheral surface of the fixing roller and a heater is controlled to maintain almost a constant temperature of about 160° C. to 200° C. on the surface of the fixing roller. The pressurizing roller includes a core having an outer surface covered with a layer of an offset preventing material like tetrafluoroethylen-perfluoroalkylvinylether (PFA) and polytetrafluoroethylene (PTFE). A layer of an elastic material like silicone rubber is provided on an outer surface of the core similar to that in the fixing roller.

Following is the detailed explanation of the cleaning unit 8. The cleaning unit 8 includes a cleaning blade 8*a*, a toner recovery vane 8*d*, a toner recovery coil 8*c*, a support 8*e*, and a toner recovery box that is not shown in the diagram.

The cleaning blade 8*a* removes toner that remains on the photosensitive drum 1 after transferring of an image. The cleaning blade 8*a* is disposed in the cleaning unit by sticking to the support 8*e*. There is no restriction on material of support 8*e* and it can be made of a material like a metal, plastic, and ceramics. It is desirable to use a metal plate since some strength is required to withstand pressure exerted on the support 8*e*. Particularly, it is desirable to use a stainless steel plate, an aluminum plate, and a copper plate of phosphor bronze etc. The cleaning blade 8*a* is stuck to the support 8*e* by applying an adhesive to the support, sticking the blade on it and fixing it by either heating or pressurizing.

Figure 3:
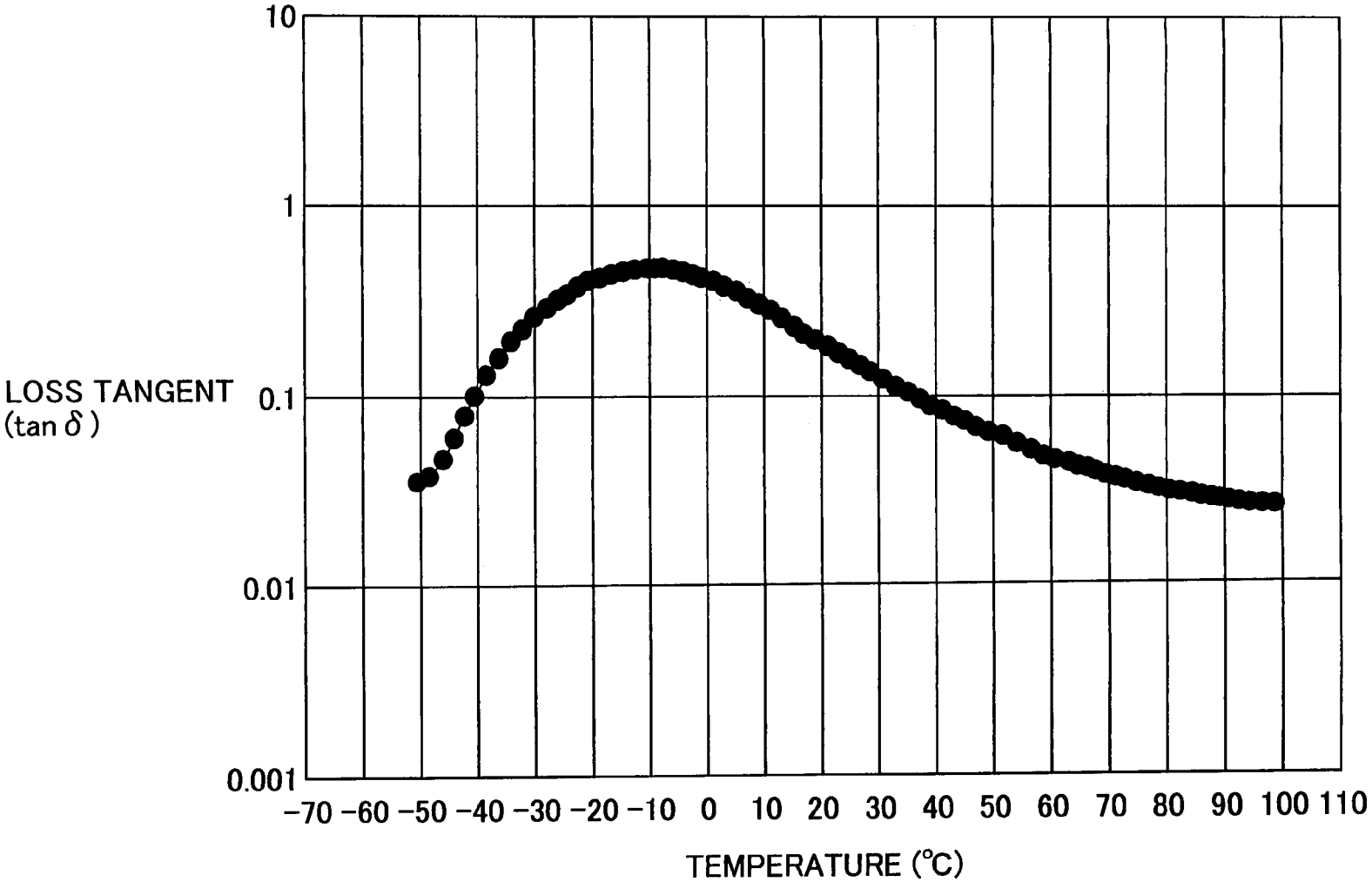
FIG. 3 is a graph of a relationship between loss tangent (tan δ) and temperature of a cleaning blade used in the cleaning unit according to the first embodiment.

When the cleaning blade 8*a* is imparted sine-wave vibrations of 10 Hz, a peak temperature of a loss tangent (tan δ) of the cleaning blade is in a range of 2° C. to −30° C. FIG. 3 is a graphical representation of a relation between temperature and tan δ of the cleaning blade. The loss tangent of the cleaning blade is a parameter of damping of energy due to an external force when the external force is exerted on the cleaning blade 8*a* and is expressed as a ratio of a loss elasticity modulus and a dynamic elasticity modulus. In particular, the loss elasticity modulus indicates viscous property and the dynamic elasticity modulus indicates elastic property. The peak temperature of tan δ can be adjusted by varying a resin material, a molecular weight, and degree of cross linkage.

If the tan δ is small, the elastic property is dominant over the viscous property. For this reason, even when the external force is exerted, due to quick recovery of deformed shape of the cleaning blade, bending of the blade is suppressed. However, since the blade tends to vibrate easily, it results in resonance and chattering of the cleaning blade 8*a*. If the tan δ is large, the viscous property is dominant over the elastic property. For this reason, the scraping of the photosensitive drum 1 is improved and the vibrations in the cleaning blade are suppressed effectively. The resonating of the cleaning blade at high temperature and chattering of the cleaning blade at low temperature are minimized, thereby achieving good cleaning of the blade.

However, it is difficult to fulfill both the properties simultaneously. To improve cleaning by improving the close contact of the cleaning blade 8*a* with the photosensitive drum 1, it is desirable that tan δ is not less than 0.01, and tan δ not less than 0.05 is more desirable.

So far, the temperature peak of tan δ was mostly kept near the room temperature. However, in the present embodiment, as is illustrated in FIG. 3, it is possible to adjust tan δ not less than 0.01 in an environmental condition that is used practically by adjusting the peak temperature of tan δ not more than 2° C. Thus, the cleaning blade 8*a* having both elastic and viscous properties to some extent, can be used in the practical environmental conditions of an image forming apparatus 100.

Moreover, the cleaning unit 8 in the present invention has a cleaning blade having a rate of change of tan δ corresponding to temperature, in a range of 0.001/° C. to 0.020/° C. in a range of temperature environment of 10° C. to 40° C. in which the image forming apparatus 100 is mostly used. Conditions of the cleaning blade, like free length, thickness, angle of contact with the photosensitive drum 1, pressure of contact, protrusion are set in an environmental condition in which the cleaning unit is normally used. However, in the cleaning blade 8*a*, which is an elastic body, the movement of molecular chain becomes active with the rise in temperature and the mechanical characteristics of high molecules of the blade change. Therefore, the best setting conditions differ according to the temperature. However, the environmental conditions change every moment and it is difficult to adjust the conditions every time. To cope with this, the peak temperature of tan δ is set on low temperature side and the rate of change of tan δ corresponding to the temperature is kept in a narrow range of 0.001 to 0.020, thereby reducing the variation in mechanical characteristics due to the change in temperature. If the rate of change of tan δ corresponding to the temperature is more than 0.020, there is a considerable variation in the mechanical characteristics and the conditions are to be adjusted for high temperature and low temperature. If the conditions are adjusted for low temperature, the blade resonates at high temperature and if the conditions are adjusted for high temperature, the blade chatters at low temperature causing improper cleaning due to the vibrations, thereby resulting in defective image.

These characteristics were measured by a dynamic viscosity elasticity measuring equipment (a spectrometer manufactured by IWAMOTO PRECISION EQUIPMENT CO., LTD), and were measured at a frequency of 10 Hz.

Moreover, the examples of elastic material having a small coefficient of friction that can be used for the cleaning blade 8*a* in the present invention are urethane elastomers, silicone elastomers, and fluorine elastomers among urethane resins, silicone resins, fluorine resins etc. Examples of silicone elastomers are methylvinyl silicone rubber, silicone fluoride rubber, and silicone urethane formed by silicone-modified polyol. Moreover, examples of fluorine resins are rubbers containing fluorine like propylene tetrafluoroethylene alternating copolymer and polyvinylidene fluoride. Thus, an elastic material like a fluorine elastomer, a silicone elastomer, and a urethane elastomer is used in the cleaning blade 8*a*.

It is desirable to have a thermosetting urethane resin as a material for the cleaning blade 8*a* and a urethane elastomer is more desirable due to its abrasion and wear resistance, ozone resistance, and contamination resistance. Urethane rubber is also included in a urethane elastomer. The raw materials for a urethane elastomer include mainly polyol, polyisocyanate, and a setting agent. In polyols, there are polyether based polyols and polyester based polyols. The concrete examples are polyester polyol, polyether polyol, caprolactone ester polyol, and polycarbonate ester polyol. These can also be used after mixing. In polyisocyanates, there are aromatic polyisocyanates and aliphatic polyisocyanates. The concrete examples are diphenylmethane diisocyanate (MDI), tolylene diisocyanate (TDI), naphthalene diisocyanate (NDI), and hexamethylene diisocyanate (HDI). Furthermore, among stiffening agents, there are amines, glycols, and triols. The concrete examples are 1,4-butanediol, ethylene glycol, trimethylolpropane. Moreover, reinforcing agents (carbon black, clay), softening agents (paraffin oil), increased heat resisting agents (antimony trioxide), and colorants (titanium oxide) can also be added.

Following is the method for manufacturing the cleaning blade 8*a* made of a urethane elastomer. A molding die for the cleaning blade is prepared. Polyisocyanate, polyol, and a setting agent are mixed in a receptacle and stirred. The prepared mixture is poured into the molding die, heated up, and then allowed to undergo a hardening reaction. After being hardened, it is demolded to obtain the urethane elastomer composition. The prepared urethane elastomer composition is cut in the form of a blade and the ends of the blade are processed to obtain a finished mold in the form of a cleaning blade.

It is desirable to have the strength (JIS-A) of the cleaning blade 8*a* in the cleaning unit 8 in the present invention, in a range of 65 degrees to 85 degrees. The cleaning blade having the strength of less than 65 degrees deforms considerably, thereby causing problems in cleaning. It is desirable that the cleaning blade has a thickness in a range of 0.8 millimeters to 3.0 millimeters and a protrusion in a range of 3 millimeters to 15 millimeters. Since the cleaning blade 8*a* in the cleaning unit in the present invention maintains a uniform angle of contact and exerts a uniform pressure, it is desirable that the cleaning blade is either fixed to the support 8*e* or integrated in the support.

Moreover, it is desirable to have the contact pressure exerted by the cleaning blade 8*a* in a range of 10 gf/cm to 60 gf/cm. If the contact pressure is less than 10 gf/cm, it is difficult to clean a toner having particle size less than 2 micrometers and if the contact pressure is more than 60 gf/cm, it results in deterioration of cleaning capability caused by bending of a tip of the cleaning blade or becoming apt to bounding or chattering of the cleaning blade. It is desirable that the angle of contact is in a range of 5 degrees to 25 degrees from a line of contact of the contact position. If the angle of contact is less than 5 degrees, it results in tendency of slipping of toner thereby causing improper cleaning. If the angle of contact is greater than 25 degrees, the blade is apt to bending during cleaning. It is desirable that the tip of the cleaning blade 8*a* is pressing against the surface of the photosensitive drum 1 such that there is a dent in a range of 0.1 millimeters to 2.0 millimeters on the surface of the photosensitive drum. If the dent is less than 0.1 millimeters, an area of contact between the cleaning blade and the photosensitive drum is less, thereby allowing the toner to slip through, resulting in improper cleaning. If the dent is more than 2.0 millimeters, the force of friction with the photosensitive drum is high, thereby making the blade apt to bending and bounding. Moreover, the resonating and chattering of the blade result in improper cleaning.

Figure 4:
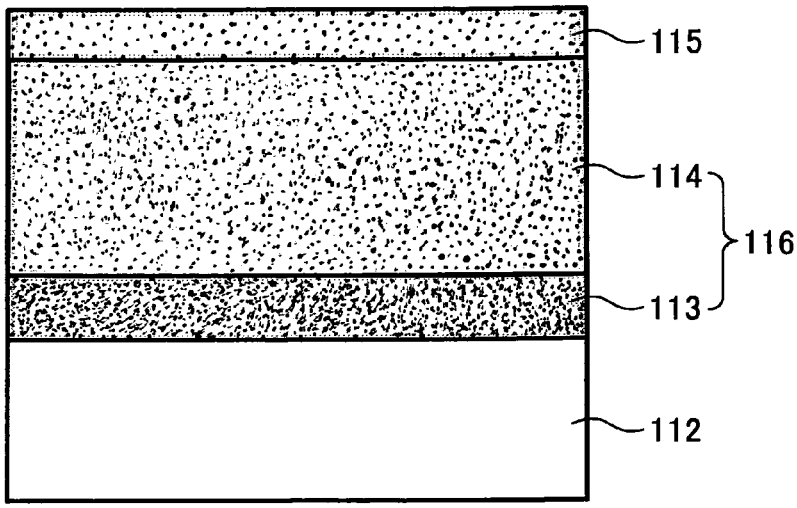
FIG. 4 is a schematic diagram of a structure of the photosensitive drum that is cleaned by the cleaning unit.

FIG. 4 is a schematic diagram of a structure of the photosensitive drum that is cleaned by the cleaning unit in the present invention. Although, the photosensitive drum is explained by referring to the photosensitive drum 1 in a form of a drum, the present embodiment is not restricted only to a drum and it may be a photosensitive drum in a form of a belt as well. The photosensitive drum 1 includes a photoconductive layer 116 that is formed by a charge generating layer 113 having a charge generating material as a principal constituent and a charge transporting layer 114 having a charge transporting material as a principal constituent piled up on a conductive support 112. A protective layer 115 is the outermost layer. A metal drum formed by a metal like an aluminum and stainless steel or an endless belt made of a metal like nickel is used for the photoconductive support 112.

The principal constituent of the charge generating layer 113 is a charge generating material and monoazo pigments, bisazo pigments, trisazo pigments, and phthalocyanine based pigment is an example of the charge generating material. The charge generating layer 113 is formed by allowing to disperse these charge generating materials in a solvent like tetrahydrofuran and cyclohexanone together with a binder resin of polycarbonate etc. and applying a coat of this dispersion solution. Coat is applied by either a submerged coating or by a spray coating. The film thickness of the charge generating layer 113 is normally in a range of 0.01 micrometers to 5 micrometers and the desirable range of thickness is 0.1 micrometers to 2 micrometers.

The charge transporting layer 114 is formed by dissolving and dispersing the charge transporting material and a binder resin in a suitable solvent like tetrahydrofuran, toluene, and dichloroethane, applying a coat of this solution, and then drying. A plasticizer or a leveling agent can also be added if required. Among the charge transporting materials, as low molecular charge transporters, there are electron transporters and positive-hole transporters. The examples of electron transporters are electron acceptors like chloranil, bromanil, tetracyanoethylene, tetracyanodimethane, 2,4,7-trinitro-9-fluorinates, 2,4,5,7-tetranitro-9-fluorenone, 1,3,7-trinitrodibenzothiophene-5,5-dioxide. The examples of positive-hole transporters are electron donors like derivatives of oxazole, derivatives of oxadiazole, derivatives of imidazole, derivatives of triphenylamine, derivatives of phenylhydrazone, derivatives of α-phenylstilbenes, derivatives of thiazole, derivatives of triazole, derivatives of phenazines, derivatives of acridines, and derivatives of thiophene.

The examples of binder resins that are used in the charge transporting layer 114 together with the charge transporting material are thermoplastic resins or thermosetting resins like polystyrene resins, styrene-acrylonitrile copolymers, styrene-butadiene copolymers, polyester resins, polyallylate resins, polycarbonate resins, acrylic resins, epoxy resins, melamine resins, and phenol resins. The thickness of the charge transporting layer may be selected in accordance with the required characteristics of the photosensitive drum in a range of 5 micrometers to 30 micrometers.

Moreover, an undercoat layer can be applied between the surface of the photoconductive support 112 and the photoconductive layer 116 of the photosensitive drum 1. Normally, the undercoat layer is formed by a resin as its principal constituent. Since a solution of the photoconductive layer 116 is applied on this undercoat resin layer, it is desirable that a resin used for this layer is a highly solubility resistant resin. The examples of these highly solubility resistant resins are water-soluble resins like polyvinyl alcohol resins, alcohol soluble resins like copolymer nylons, hard resins that form a three-dimensional network structure like polyurethane resins, alkyd melamine resins, and epoxy resins. Moreover, fine powder of metal oxides like titanium oxide, silica, and alumina may be added to the undercoat layer for prevention of moiré and reduction of residual charge. The undercoat layer can be formed similarly as the photoconductive layer by using a suitable solvent and method for application. The suitable thickness of the undercoat layer is in a range of 0 micrometers to 5 micrometers.

The protective layer 115 that includes a filler is provided further as an outer layer with the purpose of protection and durability of the photoconductive layer 116. A fine powder of metal oxides like titanium oxide, silica, and alumina can be used as a filler to be added to the protective layer. If the particle size of the filler is too big, the exposed light gets scattered by the protective layer causing deterioration of the resolving power, thereby resulting in poor image quality. The desirable thickness of the protective layer is in a range of 3 micrometers to 10 micrometers. A charge transporting material or an antioxidant can also be added to the protective layer.

It is also possible to allow to disperse and use a powder and particles of any one of or plurality or those having different particle size of metal salts of fatty acids like a fluorine resin, a compound of fluorine, carbon fluoride, molybdenum sulfide, zinc stearate or as a material for lowering the coefficient of friction. Particularly, the particles of a fluorine resin are desirable. The examples of fluorine resins are polytetrafluoro ethylene (PTFE) which is a chemical name of tetrafluoro ethylene resin, tetrafluoro ethylene-per-fluoroalkylvinyl ether copolymer, which is a chemical name of tetrafluoro ethylene per fluoroalkoxy ethylene copolymer resin (PFA), tetrafluoro ethylene-hexafluoropropylene copolymer, which is a chemical name of tetrafluoro ethylene propylene hexafluoride copolymer resin (FEP), tetrafluoro ethylene-ethylene copolymer, which is a chemical name of tetrafluoro ethylene ethylene copolymer resin (ETFE), polyvinylidene fluoride, which is a chemical name of fluorovinylidene resin: PVDF, polychloro trifluoro ethylene, which is a chemical name of chlorotrifluoro ethylene resin (PCTFE), tetrafluoro ethylene-perfluorodimethyldioxole copolymer resin (TFEPDD), and polyvinyl fluoride, which is a chemical name of fluorovinyl resin (PVF).

PTFE is desirable among these fluorine resins. The molecular structure of PTFE is such that it is a perfectly symmetrical linear high molecule where the $CF_2$ is repeated simply. Moreover, the symmetry of molecules is such that they are highly non-polar high molecules and the cohesive force between the molecules is extremely weak. Furthermore, the surface of a molecular chain is very smooth. The coefficient of friction is low due to the weak cohesive force between the molecules and less unevenness on surface of the molecular chain. PTFE being very soft and the cohesive force between the molecules being very weak, the molecules of PTFE tend to slip from one another. Due to this sliding, the resistance due to friction of PTFE with many other materials can be reduced. While using this, it is desirable that the coefficient of static friction of the surface of the photosensitive drum is not more than 0.4, considering the cleaning of the toner and additives remained on the surface of the photosensitive drum. It is more desirable that the coefficient of static friction of the surface of the photosensitive drum is in a range of 0.3 to 0.1. If the coefficient of static friction is more than 0.4, the friction between the cleaning blade and the photosensitive drum is more, thereby resulting in bending of the blade and resonance due to vibrations in the blade. If the coefficient of static friction is less than 0.1, the cleaning blade slips on the surface of the photosensitive drum and the toner slips through the photosensitive drum and the cleaning blade.

Figure 5:
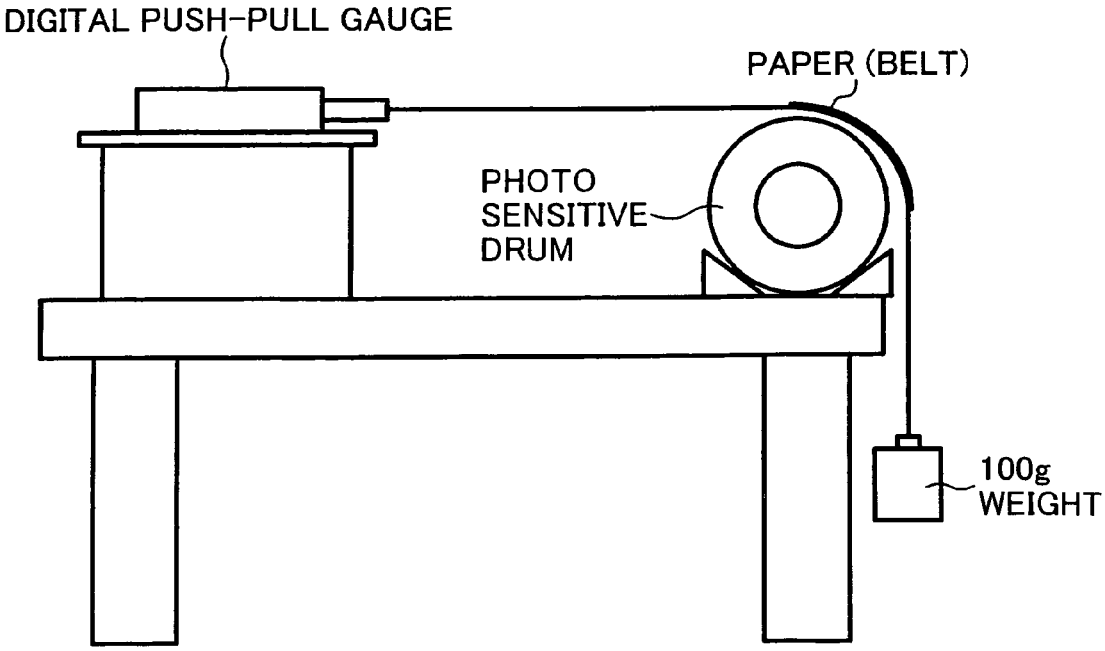
FIG. 5 is a schematic diagram of a measurement setup for static friction coefficient of the photosensitive drum.

The coefficient of static friction of the photosensitive drum 1 was measured by Euler's method as mentioned below. FIG. 5 is an illustration of measurement of the coefficient of static friction of the photosensitive drum. In this case, a good quality paper of medium thickness is stretched as a belt over one fourth of a circumference of the photosensitive drum longitudinally in the direction of pulling, a weight of 98 N (100 gm) is suspended from one side of the belt and a force gauge installed on the other end is pulled, and a load when the belt is moved is read out to be substituted in a following relation:

$$\mu=2/\pi\times 1n(F/0.98) \quad (1)$$

where, μ is a coefficient of static friction and F is a measured value.

The cleaning unit in the present invention may be installed in the process cartridge. In the process cartridge in which the cleaning unit in the present invention is used, the photosensitive drum 1, which is an image carrier and the cleaning unit that removes toner carried to the photosensitive drum 1, are supported integrally. The process cartridge is detachable from the image forming apparatus and is provided with the cleaning unit 8 that is disposed in a position. The cleaning blade 8*a* reduces the peak temperature of tan δ on lower side of not more than 2° C., thereby reducing the change in temperature while scraping the photosensitive drum 1 in environmental conditions of wide range in which the process cartridge is used. Due to this, resonance, chattering, and bending of the blade at a high temperature can be suppressed, thereby preventing a faulty image resulted from the improper cleaning.

Furthermore, the cleaning unit in the present invention may also be installed in an image forming apparatus. The image forming apparatus 100 in the present invention includes the photosensitive drum 1, which is an image carrier that forms an electrostatic latent image, the charging unit 2 that charges the surface of the photosensitive drum 1 uniformly, the exposing unit 3 that irradiates the laser beam 3*a* on the surface of the charged photosensitive drum 1 based on the image data and writes an electrostatic latent image, the toner unit 4 that supplies toner to the electrostatic latent image that is formed on the surface of the photosensitive drum 1 and forms a visualized image, the transferring unit 6 that transfers the visualized image on the surface of the photosensitive drum 1 to a recording paper, cleaning unit 8 that cleans the surface of the photosensitive drum 1 after having transferred the image. The cleaning unit 8 explained earlier is mentioned in this image forming apparatus 100. The cleaning blade 8*a* reduces the peak temperature of tan δ on lower side of not more than 2° C., thereby reducing the change in temperature while scraping the photosensitive drum 1 in environmental conditions of wide range in which the image forming apparatus is used. Due to this, resonance, chattering, and bending of the blade at a high temperature can be suppressed thereby preventing a faulty image resulted from improper cleaning. Thus, the toner and additive adhered on the surface of the photosensitive drum 1 can be removed regularly over a long period of time before the photosensitive drum 1 reaches the end of its life, thereby preventing formation of low quality image having a white patch in the beta image.

Anyone of a two-component developer consisting of a magnetic carrier and a toner, a magnetic one-component developer, and a non-magnetic one-component developer may be used in the image forming apparatus 100. Although the toner used in this embodiment is a toner prepared by dry pulverization after melting and kneading, it may also be a toner prepared by wet polymerization in a solvent.

The wet polymerization may be any one of a suspension polymerization method, an emulsion polymerization method, and a flocculation (agglomeration) method. However, it is desirable to use a toner prepared by allowing to disperse a toner material consisting of a prepolymer, a polyester, a colorant, and a mold releasing agent into an aqueous solvent in the presence of fine particles of resin and allowing to undergo polyaddition reaction.

The ingredients of a toner to be used in the image forming apparatus 100 and the method of preparation are explained below.

All known dyes and pigments can be used as a colorant. For example, carbon black, nigrosine dye, iron black, naphthol yellow S, hanza yellow (10G, 5G, and G), cadmium yellow, yellow iron oxide, ocher, chrome yellow, titan yellow, polyazo yellow, oil yellow, hanza yellow (GR, A, RN, and R), pigment yellow L, benzidine yellow (G and GR), permanent yellow (NCG), vulcun fast yellow (5G and R), tartrazine lake, quinoline yellow lake, anthrazan yellow BGL, isoindolinone yellow, bengala (Indian red), red lead (minium), vermilion lead, cadmium red, cadmium mercury red, antimony red, permanent red 4R, para red, p-chloro o-nitro aniline red, lithol fast scarlet G, brilliant fast scarlet, brilliant carmine BS, permanent red (F2R, F4R, FRL, FRLL, F4RH), fast scarlet VD, vulcun fast rubin B, brilliant scarlet G, lithol rubin GX, permanent red F5R, brilliant carmine 6B, pigment scarlet 3B, bordeaux 5B, toluedine maroon, permanent bordeaux F2K, helio bordeaux BL, bordeaux 10B, bon maroon light, bon maroon medium, eosin lake, rhodamine lake B, rhodamine rake Y, alizarine lake, thioindigo red, thioindigo maroon, oil red, quinacridone red, pyrazolone red, polyazo red, chrome vermilion, benzidine orange, perynone orange, oil orange, cobalt blue, cerulian blue, alkali blue lake, peacock blue lake, victoria blue lake, metal-free phthalocyanine blue, phthalocyanine blue, fast sky blue, indanthrene blue (RS and BC), indigo, ultramarine blue, prussian blue, anthraquinone blue, fast violet B, methyl violet lake, cobalt violet, manganese violet, dioxane violet, anthraquinone violet, chrome green, zinc green, chromium oxide, pyridian (viridian), emerald green, pigment green B, naphthol green B, green gold, acid green lake, malachite green lake, phthalocyanine green, anthraquinone green, titanium oxide, Chinese white (zinc oxide), lithopone, and mixtures of these can be used as pigments and dyes. The content of colorant in a toner is normally from 1 weight percent to 15 weight percent of that of the toner, the desirable content being from 3 weight percent to 10 weight percent.

The colorant can also be used as a master batch mixed with a resin. Examples of binder resin to be kneaded with the master batch or used in the preparation of the master batch are, styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified resin terpene resins, aliphatic and alicyclic hydrocarbon resins, chlorinated paraffins, paraffin wax etc. which can be used solely or by mixing.

The polyester is obtained by a polycondensation reaction of a polyhydric alcohol compound with a polyhydric carboxylic acid compound.

The examples of the polyhydric alcohol compounds (PO) are dihydric alcohols (DIO) and polyhydric alcohols not below a trihydric alcohol (TO). The dihydric alcohol (DIO) alone or a mixture of a small quantity of trihydric alcohol (TO) with a dihydric alcohol (DIO) is desirable. The examples of dihydric alcohol (DIO) are, alkylene glycols (e.g. ethylene glycol, 1,2-propylene glycol, 1,3-propylene glycol, 1,4-butanediol, and 1,6-hexanediol), alkylene ether glycols (e. g. diethylene glycol, triethylene glycol, dipropylene glycol, polyethylene glycol, polypropylene glycol, and polytetramethylene ether glycol), alicyclic diols (e.g. 1,4-cyclohexanedimethanol and hydrogen additive bisphenol A), bisphenols (e.g. bisphenol A, bisphenol F, and bisphenol S), adducts of alkylene oxides of these alicyclic diols (e.g. ethylene oxide, propylene oxide, and butylene oxide), adducts of alkylene oxides of the phenols (e.g. ethylene oxide, propylene oxide, and butylene oxide). The adducts of alkylene oxides of the bisphenols and alkylene glycol having a carbon number from 2 to 12 are desirable. The adducts of alkylene oxides of bisphenols and the adducts of alkylene oxides of bisphenols together with the alkylene glycol having a carbon number from 2 to 12 are particularly desirable. Examples of polyhydric alcohols not below trivalent alcohols (TO) are polyhydric aliphatic alcohols from trivalent to octavalent alcohols and above (e.g. glycerin, trimethylolethane, trimethylolpropane, pentaerythritol, and sorbitol), phenols not below trivalent phenols (e.g. trisphenol PA, phenol novolak, and cresol novolak), and adducts of alkylene oxides of polyphenols not below trivalent polyphenols.

Examples of polyhydric carboxylic acid (PC) are dihydric carboxylic acid (DIC) and polyhydric carboxylic acids (TC) not below trivalent carboxylic acid. The dihydric carboxylic acid (DIC) alone or a mixture of a small quantity of trihydric carboxylic acid (TC) with a dihydric carboxylic acid (DIC) is desirable. The examples of dihydric carboxylic acid are, alkylene dicarboxylic acids (e.g. succinic acid, adipic acid, and sebacic acid), alkenylene dicarboxylic acids (e.g. maleic acid and fumaric acid), and aromatic dicarboxylic acids (e.g. phthalic acid, isophthalic acid, terephthalic acid, and naphthaline dicarboxylic acid). Among these, the alkenylene dicarboxylic acids having a carbon number from 4 to 20 and the aromatic dicarboxylic acids having a carbon number from 8 to 20 are desirable. The examples of the polyhydric carboxylic acids not below trivalent carboxylic acid are aromatic polyhydric carboxylic acids having a carbon number from 9 to 20 (e.g. trimellitic acid and pyromellitic acid). The acid anhydrides and low alkyl esters of these can be used as polyhydric carboxylic acids and may be allowed to react with the polyhydric alcohols (PO).

The ratio of the polyhydric alcohol (PO) and the polyhydric carboxylic acid (PC) is an equivalent ratio [OH]/[COOH] of a hydroxyl group [OH group] and a carboxyl group [COOH group] and is generally in a range of 2/1 to 1/1. The desirable ratio is in a range of 5/1 to 1/1 and a range of 1.3/1 to 1.02/1 is particularly desirable.

The polycondensation reaction of the polyhydric alcohol (PO) with the polyhydric carboxylic acid (PC) is carried out by allowing to react the two in the presence of a known esterification catalyst and the mixture is heated up to 150° C. to 280° C. The pressure is reduced if necessary and the water generated is removed by evaporation. Thus, polyester that uses a hydroxyl group is obtained. It is desirable that a hydroxyl value of the polyester is not less than 4 and an acid value of polyester is in a range of 1 to 30 normally, the desirable acid value being in a range of 5 to 20. Imparting of an acid value tend to charge it negatively and when fixed on a recording medium, due to good affinity between the recording medium and the toner, there is a better fixing at a low temperature. However, if an acid value is more than 30, it results in instable charging, particularly tending to be deteriorated according to change in the environment.

Moreover, the weight average molecular weight is in a range of 10,000 to 400,000, the desirable range being 20,000 to 200,000. If the weight average molecular weight is less than 10,000, there is a deterioration of offset resistance hence it is not desirable. On the other hand, if the weight average molecular weight is more than 400,000, the fixing at low a temperature is affected, hence it is not desirable.

A urea-modified polyester is included in polyester apart from non-modified polyester obtained by the polycondensation reaction. The urea-modified polyester is obtained by allowing to react either a carboxyl group or a hydroxyl group at a terminal of the polyester that is obtained by polycondensation reaction, with polyhydric isocyanate compound (PIC), thereby obtaining a polyester prepolymer (A) having an isocyanate group. When this polyester prepolymer is allowed to undergo polyaddition reaction with an amine, there is an extension of a molecular chain and the urea polyester is obtained.

Examples of polyhydric isocyanate compounds (PIC) are aliphatic polyhydric isocyanates (e.g. tetramethylene diisocyanate, hexamethylene diisocyanate, and 2,6-diisocyanate methyl caproate), alicyclic polyisocyanates (e.g. isophorone diisocyanate and cyclohexylmethane diisocyanate), aromatic diisocyanates (e.g. tolylene diisocyanate and diphenylmethane diisocyanate), aromatic aliphatic diisocyanates (e.g. α,α,α',α'-tetramethylxylylene diisocyanate), isocyanurates, compounds formed by blocking of these polyisocyanates by a phenol derivative, an oxime, and a caprolactum, and combination of more than any one of these.

The ratio of the polyhydric isocyanate compound (PIC) is an equivalent ratio [NCO]/[OH] of an isocyanate group [NCO] and a hydroxyl group [OH] of a polyester and is generally in a range of 5/1 to 1/1. The desirable ratio is in a range of 4/1 to 1.2/1 and a range of 2.5/1 to 1.5/1 is particularly desirable. If the ratio of [NCO]/[OH] is more than 5, the fixing of an image at a low temperature is affected. If the mole ratio of [NCO] is less than 1, in a case where urea non-modified polyester is used, the urea content in the ester becomes low, thereby affecting the offset resistance.

The content of the polyhydric isocyanate compound (PIC) in the polyester prepolymer (A) having an isocyanate group, is normally in a range of 0.5 weight percent to 40 weight percent. The desirable range of the content of the polyhydric isocyanate compound is 1 weight percent to 30 weight percent and a range of 2 weight percent to 20 weight percent is more desirable. If the content of the polyhydric isocyanate compound is less than 0.5 weight percent, the hot offset resistance is deteriorated and it is unfavorable from point of view of compatibility of heat conserving resistance and fixing at a low temperature. On the other hand, if the content of the polyhydric isocyanate compound is more than 40 weight percent, there is a deterioration of fixing at a low temperature.

The content of the isocyanate group per molecule in the polyester prepolymer (A) having an isocyanate group is normally 1. The desirable range of the content of the isocyanate group is on average 1.5 to 3 and a range of 1.8 to 2.5 is more desirable. If the content of the isocyanate group per molecule is less than 1, then the molecular weight of the urea-modified polyester becomes low and the hot offset resistance is deteriorated.

Further, the examples of amine (B) that is allowed to react with the polyester prepolymer are dihydric amine compound (B1), polyhydric amine compound (B2) not below trivalent amines, aminoalcohol (B3), aminomercaptan (B4), amino acid (B5), and compound (B6) in which the amino groups from B1 to B5 are blocked.

The examples of dihydric amine compound (B1) are, aromatic diamines (e.g. phenylene diamine, diethylene diamine, and 4,4'-diaminodiphenyl methane), alicyclic diamines (e.g. 4,4'-diamino-3,3'-dimethyldicyclohexylmethane, diamine cyclohexane, and isophorone diamine), and aliphatic diamines (e.g. ethylene diamine, tetramethylene diamine, and hexamethylene diamine. The examples of polyhydric amine compound (B2) not below trivalent amines are diethylene triamine and triethylene tetramine. The examples of aminoalcohol (B3) are ethanolamine and hydroxyethylaniline. The examples of aminomercaptan (B4) are aminoethyl mercaptan and aminopropyl mercaptan. The examples of amino acid (B5) are aminopropionic acid and caproic acid. The examples of compound (B6) in which the amino groups from B1 to B5 are blocked are, ketimine compounds and oxazolidine compounds obtained from the amines in B1 to B5 above ketones (e.g. acetone, methyl ethyl ketone, and methyl isobutyl ketone). The desirable amines among the amines (B) are B1 and a mixture of B1 with a small amount of B2.

The ratio of amines is an equivalent ratio [NCO]/[NHx] of an isocyanate group [NCO] in the polyester prepolymer (A) having an isocyanate group and an amine group [NHx] in the amines (B) and is generally in a range of 1/2 to 2/1. The desirable ratio is in a range of 1.5/1 to 1/1.5 and a range of 1.2/1 to 1/1.2 is particularly desirable. If the ratio of [NCO]/[NHx] is greater than 2 or less than ½, the molecular weight of the urea-modified polyester decreases and the hot offset resistance is deteriorated.

Moreover, a urethane bond may be included together with a urea bond in the urea-modified polyester. The mole ratio of the urea bond content and the urethane bond content is normally in a range of 100/0 to 10/90. The desirable ratio is in a range of 80/20 to 20/80 and a range of 60/40 to 30/70 is more desirable. If the mole ratio of the urea bond is less than 10 percent, the hot offset resistance is deteriorated.

The urea-modified polymer is manufactured by a method like a one-shot method. A polyhydric alcohol (PO) and a polyhydric carboxylic acid (PC) are heated up to 150° C. to 280° C. in the presence of a known esterification catalyst like tetrabutoxy titanate and dibutyl tin oxide. The pressure is reduced if necessary and the water generated is removed by evaporation. Thus, polyester having a hydroxyl group is obtained. Further, the polyester is heated up to 40° C. to 140° C. and a polyhydric isocyanate (PIC) is allowed to react with the heated polyester to obtain a polyester prepolymer (A) having an isocyanate group. Furthermore, an amine (B) is allowed to react with this polyester prepolymer (A) at a temperature from 0° C. to 140° C. to obtain a urea-modified polyester.

A solvent can be used if necessary while allowing to react PIC as well as (A) and (B). The examples of a solvent that can be used are aromatic solvents (e.g. toluene and xylene), ketones (e.g. acetone, methyl ethyl ketone, and methyl isobutyl ketone), esters (e.g. ethyl acetate), amines (e.g. dimethyl formamide, and dimethyl acetoamide), and ethers (e.g. tetrahydrofuran) that are inert to isocyanate (PIC).

Furthermore, for the extension reaction of a polyester prepolymer (A) with an amine (B), an extension inhibitor can be used if necessary, to adjust the molecular weight of the urea-modified polyester that is obtained. The examples of the extension inhibitor are monoamines (e.g. diethylamine, dibutylamine, butylamine, and laurylamine) and compounds in which these are blocked (ketimine compounds).

The weight average molecular weight of the urea-modified polyester is normally not less than 10,000. The desirable weight average molecular weight is in a range of 20,000 to 10,000,000 and the weight average molecular weight in a range of 30,000 to 10,000,000 is more desirable. If the weight average molecular weight is less than 10,000, the hot offset resistance is deteriorated. The number average molecular weight of the urea-modified polyester is not restricted only in a case of using the non-modified polyester mentioned earlier and may be a number average molecular weight that is suitable to obtain the weight average molecular weight. If the urea-modified polyester is used solely, the number average molecular weight is normally in a range of 2,000 to 15,000. The desirable range is from 2,000 to 10,000 and a range of 2,000 to 8,000 is more desirable. If the number average molecular weight is greater than 20,000, the fixing at a low temperature and the gloss when a full color unit is used, are deteriorated.

Since the fixing at a low temperature and the gloss when a full color unit is used, are improved by using a non-modified polyester and a urea-modified polyester, it is more desirable to use them together rather than using the urea-modified polyester solely. Furthermore, a non-modified polyester may contain a polyester modified by a chemical bond other than the urea bond.

It is desirable that the non-modified polyester and the urea-modified polyester are at least partly compatible from the point of view of the fixing at a low temperature and the hot offset resistance. For this, it is desirable that the non-modified polyester and the urea-modified polyester have similar composition The weight ratio of the non-modified polyester and the urea-modified polyester is normally in a range of 20/80 to 95/5. The desirable weight ratio is in a range of 70/30 to 95/5 and a range of 75/25 to 95/5 is more desirable. The most desirable weight ratio is in a range of 80/20 to 93/7. If the weight ratio of the urea-modified polyester is less than 5 percent, it results in deterioration of the hot offset resistance and it is unfavorable from point of view of compatibility of heat conserving resistance and fixing at a low temperature.

The glass transition point (Tg) of a binder resin that includes a non-modified polyester and a urea-modified polyester is normally in a range of 45° C. to 65° C. The desirable range is from 45° C. to 60° C. If the glass transition point is below 45° C., the heat resistance of the toner is deteriorated and if the glass transition point is above 65° C., it results in insufficient fixing at a low temperature.

Since the urea-modified polyester tend to exist on the surface of the host particles of the toner obtained, even if the glass transition point is lower as compared to that of the known polyester based toners, it has a tendency to have good heat conserving resistance.

The known charge controlling agents that can be used are nigrosin based dyes, triphenylmethane based dyes, chrome contained metal complex dyes, molybdic acid chelate pigments, rhodamine based pigments, alkoxy amines, quaternary ammonium salts (including fluorine modified quaternary ammonium salts), alkyl amines, simple substances or compounds of phosphorus, simple substances or compounds of tungsten, fluorine based activating agents, metal salts of salicylic acid, and metal salts of salicylic acid derivatives etc. The concrete examples are BONTRON 03 as a nigrosin based dye, BONTRON P-51 as a quaternary ammonium salt, BONTRON S-34 as metal contained azo pigments, E-82 as an oxynaphtholic acid based metal complex, E-84 as a salicylic acid based metal complex, E-89 as a phenol based condensate (all manufactured by ORIENT CHEMICAL INDUSTRIES, LTD.), TP-302 and TP-415 (manufactured by HODOGAYA CHEMICAL COMPANY, LTD.) as quaternary ammonium salt molybdenum complexes, COPY CHARGE PSY VP2038 as a quaternary ammonium salt, COPY BLUE-PR as a derivative of triphenylmethane, and COPY CHARGE NEG VP 2036 and COPY CHARGE NX VP 434 as quaternary ammonium salts (all manufactured by HOECHST CO., LTD.), LR-147 as a boron complex (manufactured by JAPAN CARLIT CO., LTD.), copper phthalocyanine, perylene, quinacridone, azo based pigments, and compounds having high molecules having other sulfonic groups, carboxyl groups, and functional groups having quaternary ammonium salt. Among these, the materials that control (charge) the toner negatively are particularly desirable. The quantity of the charge controlling agent is determined by a type of a binder resin that is used, presence or absence of any additive used according to need, a method of manufacturing of toner including a method of dispersion, and is not restricted to a fixed quantity. The desirable quantity is in a range of 0.1 to 10 parts of weight per 100 parts of weight of a binder resin. The more desirable range is from 0.2 to 5 parts of weight. If the quantity is more than 10 parts of weight, there is an excessive charging of the toner and deteriorates the effect of the charge controlling agent. Moreover, the electrostatic absorption force of the developing roller increases, thereby affecting the fluidity of the developer and the image density.

A wax having a low melting point in a range of 50° C. to 120° C. functions effectively between the fixing roller and surface of toner as a good mold releasing agent during dispersion with a binder resin. Due to this effective functioning of wax, there is no need to apply a mold releasing agent as oil to the fixing roller and the high temperature offset is improved. The examples of wax are, vegetable wax like carnauba wax, cotton wax, haze wax (Japanese wax), rice wax, animal wax like bees wax and lanolin, mineral wax like ozokerite, selsyn, and petroleum wax like paraffin, micro crystalline, petrolatum. Other examples of wax apart from these natural waxes are synthetic hydrocarbon wax like Fischer Tropsch wax, polyethylene wax and synthetic wax like esters, ketones, and ethers. Furthermore, 12-hydroxy stearic acid amides, stearic acid amides, phthalic anhydride imide, fatty acid amides of chlorinated hydrocarbon, and homopolymers or copolymers (e.g. copolymers of n-stearyl acrylate-ethyl methacrylate) of poly-n-stearyl methacrylate, poly-n-lauryl methacrylate, that are crystalline high polymer resins having a low molecular weight and crystalline high polymers having a long alkyl group in a side chain can also be used.

Inorganic fine particles are desirably used as an external additive to assist the fluidity, developing, and charging of the toner particles. The primary particle size of these inorganic fine particles is in a range of $5\times10^{-3}$ micrometers to 2 micrometers and the desirable range is from $5\times10^{-3}$ micrometers to 0.5 micrometers. Further, it is desirable that the specific surface area according to BET method is in a range of 20 $m^2$ to 500 $m^2$. It is desirable that the proportion of the inorganic fine particles to be used is in a range of 0.01 weight percent to 5 weight percent of the toner and a range of 0.01 weight percent to 2.0 weight percent is particularly desirable.

The concrete examples of inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, ceric oxide, red oxide, antimony trioxide, magnesium oxide, zirconium oxide, barium sulfate, barium carbonate, calcium carbonate, silicon carbide, and silicon nitride. It is desirable to use hydrophobic silica fine particles together with hydrophobic titanium oxide fine particles as a fluidity imparting agent. Particularly, if a compound having an average particle size of both the fine particles less than $5\times10^{-2}$ micrometers is used and stirred to mix, the electrostatic force and the van der Waals force of the toner increases remarkably. Due to this, even by stirring and mixing inside the developing unit that is carried out to achieve the desired level of charging, the fluidity imparting agent is not detached from the toner. Therefore, a good image quality without any bright spot can be obtained and the amount of toner remained after the transferring of the image can be reduced.

Although the fine particles of titanium oxide are environmentally stable and have very stable image density, there is a tendency of deteriorating the charging start up characteristics. For this reason, if the quantity added of the fine particles of titanium oxide is more than that of fine particles of silica, the side effect is supposed to be more. However, with the quantity of addition of hydrophobic fine particles of silica and hydrophobic titanium oxide fine particles in a range of 0.3 weight percent to 1.5 weight percent, the charging start up characteristics are not affected to a great extent and the desired charging start up characteristics can be achieved. That is to say that a stable image quality can be achieved even when a copy is repeated.

The distribution of hardness of the toner can be obtained by analyzing the constitutive elements included in it. A polyester resin with a urethane bonding having more number of N is hard and this can be confirmed by measuring the composition distribution by an X-ray photoelectron spectroscopy (XPS). By hardening the surface of toner, even in a case of use for long time, the blocking is prohibited. Moreover, the stirring and mixing can be improved by improving the fluidity of toner particles. Since the hard toner surface signifies that the external additive cannot be penetrated into the surface of the toner, even if it is stirred for a long time in the developing unit 4, the stable fluidity and the charging characteristics can be maintained. Furthermore, by reducing the hardness of the inner side, the surface of the toner is ruptured by heat and pressure during fixing and can be deformed easily. Due to this, the fixing can be improved by allowing to expose the inner side of toner that includes the mold releasing agent.

Moreover, in the toner used in the image forming apparatus 100 in the present invention, the weight ratio of the charge controlling agent on the surface of the toner and that in the overall toner is in a range of 100 to 1,000. The charge controlling agent can be placed on the surface of the toner by mixing and stirring the charge controlling agent with the host particles. This also, can be confirmed by measuring the composition distribution by the X-ray photoelectron spectroscopy (XPS). It desirable to use a charge controlling agent that has same polarity as the charging polarity of the toner. Thus, by allowing the host particles of the toner and the external additive to have same charging characteristics, the charging start up is accelerated, thereby narrowing the extent of charging distribution. In this way, an image of a good quality can be achieved by reducing an excessive concentration of the toner at a particular point during replenishing the toner.

Following is the explanation of a method for manufacturing the toner. The method explained here is a desirable method and the manufacturing of the toner is not restricted to this method only.

(Method of Manufacturing the Toner)

1) A toner material solution is prepared by allowing to disperse a colorant, a non-modified polyester, a polyester prepolymer having an isocyanate group, and a mold releasing agent in an organic solvent.

It is desirable to have a volatile organic solvent having a boiling point below 100° C. since the removal after forming of the host particles of the toner is easy. Concretely, toluene, xylene, benzene, carbon tetrachloride, methylene chloride, 1,2-dichloromethane, 1,1,2-trichloroethane, trichloroethylene, chloroform, monochlorobenzene, dichloroethylidine, methyl acetate, ethyl acetate, methyl ethyl ketone, methyl isobutyl ketone etc. can be used solely or a combination of more than one of these. Particularly, aromatic solvents of toluene, xylene etc. and halogen hydrocarbons of methylene chloride, 1,2-dichloroethane, chloroform, carbon tetrachloride etc. are desirable. The amount of the organic solvent to be used is normally in a range of 0 to 300 parts of weight per 100 parts of weight of the polyester prepolymer. The desirable amount is in a range of 0 to 100 parts of weight and a range of 25 to 27 parts of weight is more desirable.

The toner material is emulsified in an aqueous medium in the presence of a surfactant and fine particles of resin.

An aqueous medium may be solely water or an aqueous medium containing an organic solvent like an alcohol (methanol, isopropyl alcohol, ethylene glycol etc.), dimethyl formamide, tetrahydrofuran, a cellosorb (methyl cellosorb etc.), a lower ketone (acetone, methyl ethyl ketone etc.).

The amount to be used of an aqueous medium per 100 parts of weight of the toner material solution is normally in a range of 50 to 2000 parts of weight and it is desirable to have this amount in a range of 100 to 1000 parts of weight. If the amount is less than 50 parts of weight, it affects the dispersion of the toner material solution and toner particles of prescribed particle size cannot be obtained. An amount of more than 2,000 is not economical.

Further, to improve the dispersion in the aqueous medium, an appropriate dispersing agent like a surfactant, fine particles of resin are added.

The examples of a surfactant are anionic surfactants like alkyl benzene sulfonate, α-olefin sulfonate, ester phosphate, an amine salts like alkyl amine salts, aminoalcohol fatty acid derivatives, polyamine fatty acid derivatives, imidazoline, cationic surfactants of quaternary ammonium salt types like alkyl trimethyl ammonium salts, dialkyl dimethyl ammonium salts, alkyl dimethyl benzyl ammonium salts, pyridinium salts, alkyl isoquinolinium salts, benzethonium chloride, nonionic surfactants of fatty acid amide derivatives and polyhydric alcohol derivatives like alanine, dodecyl di (aminoethyl) glycine, di (octylaminoethyl) glycine and ampholytic surfactants like N-alkyl-N, N-dimethyl ammonium betaine etc.

Furthermore, by using a surfactant having a fluoroalkyl group, a desired effect can be achieved with a very small quantity. The examples of desirable anionic surfactants having a fluoroalkyl group are fluoroalkyl carboxylic acids and their metal salts having a carbon number from 2 to 10, disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and its metal salts, perfluoroalkyl carboxylic acid (C7 to C13) and its metal salts, perfluoroalkyl (C4 to C12) sulfonic acid and its metal salts, perfluorooctane sulfonic acid diethanolamide, N-propyl-N-(2-hydroxyethyl) perfluorooctane sulfonamide, perfluoroalkyl (C6 to C10) sulfonamide propyltrimethyl ammonium salts, perfluoroalkyl (C6 to C10)-N-ethylsulfonyl glycine salts, ester mono-perfluoroalkyl (C6 to C16) ethyl phosphate.

The examples of commercial products available are SURFLON S-111, S-112, S113 (manufactured by ASAHI GLASS CO., LTD.), FLUORAD FC-93, FC-95, FC-98, FC-129 (manufactured by SUMITOMO 3M CO., LTD.), UNIDINE DS-101, DS-102 (manufactured by DAIKIN INDUSTRIES, LTD.), MEGAFACE F-110, F-120, F-113, F-191, F-812, F-833 (manufactured by DAI NIPPON INK & CHEMICALS, INC.), EKTOP EF-102, 103, 104, 105, 112, 123A, 123B, 306A, 501, 201, 204 (manufactured by TOCHEM PRODUCTS CO., LTD.), and FTERGENT F-100 and F150 (manufactured by NEOS CO., LTD).

The examples of cationic surfactants are primary aliphatic, secondary aliphatic or secondary amino acid having a fluoroalkyl group, quaternary aliphatic ammonium salts like perfluoroalkyl (C6 to C10) sulfonamide propyltrimethyl ammonium salt etc., benzalkonium salts, benzethonium chloride, pyridinium salts, imidazolinium salts. The examples of commercial products are SURFLON S-121 (manufactured by ASAHI GLASS CO., LTD.), FLUORAD FC-135 (manufactured by SUMITOMO 3M CO., LTD.), UNIDINE DS-202 (manufactured by DAIKIN INDUSTRIES, LTD.), MEGAFACE F-150 and F-824 manufactured by DAI NIPPON INK & CHEMICALS, INC.), EKTOP EF-132 (manufactured by TOCHEM PRODUCTS CO., LTD.), FTERGENT F-300 (manufactured by NEOS CO., LTD).

The fine particles of resin are added to stabilize the host particles of toner that are formed in the aqueous medium. Therefore, it is desirable that the fine particles of resin are added to make 10 to 90 percent covering on the surface of the host particles of the toner. The examples are fine particles of methyl polymethacrylate having a particle size of 1 micrometer and 3 micrometers, fine particles of polystyrene having a particle size of 0.5 micrometers and 2 micrometers, fine particles of poly (styrene-acryinitrile) having a particle size of 1 micrometer. The examples of commercial products are PB-200H (manufactured by KAO CORPORATION), SGP (manufactured by SOKEN CO., LTD.), TECHPOLYMER-SB (manufactured by SEKISUI CHEMICAL CO., LTD.), SGP-3G (manufactured by SOKEN CO., LTD.), and MICROPEARL (manufactured by SEKISUI FINE CHEMICAL CO., LTD.).

Moreover, inorganic dispersing agents like calcium phosphate-tribasic, calcium carbonate, titanium oxide, colloidal silica, and hydroxyapatite can also be used.

The dispersion droplets may be stabilized by a high polymer protective colloid as a dispersing agent that can be used both as fine particles of resin and of an inorganic dispersing agent. For example acids like acrylic acid, methacrylic acid, α-cyanoacrylic acid, α-cyanomethacrylic acid, itaconic acid, crotonic acid, fumaric acid, maleic acid or anhydrous maleic acid, or (metha) acrylic monomers that include a hydroxyl group like, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethyleneglycol monoacrylic ester, diethyleneglycol monomethacrylic ester, glycerine monoacrylic ester, glycerine monomethacrylic ester, N-methylol acrylamide, N-methylol methacrylamide, vinyl alcohols or ethers of vinyl alcohols like vinyl methyl ether, vinyl ethyl ether, vinyl propyl ether, or esters of compounds that include a vinyl alcohol or a carboxyl group like vinyl acetate, vinyl propionate, vinyl butyrate, acrylamides, methacrylamides, diacetoneacrylamide or their methylol compounds, acid chlorides like an acrylic acid chloride, a methacrylic acid chloride, nitrogenous substances like vinyl pyridine, vinyl pyrrolidine, vinyl imidazole, ethyleneimine and homopolymers or copolymers of compounds having the heterocycles of these substances, polyoxyethylenes like polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene lauryl ether, polyoxyethylene stearylphenyl ester, celluloses like methyl cellulose, hydroxyethyl cellulose, hydroxypropyl cellulose etc. are used.

The dispersion method is not restricted and a known apparatus like low-speed shearing disperser, high-speed shearing disperser, friction disperser, high-pressure jet disperser, and ultrasonic disperser can be used. Among these, the high-speed shearing disperser is desirable to make the particle size of a dispersing element from 2 micrometers to 20 micrometers. If the high-speed shearing disperser is used, the revolutions per minute (rpm) are not restricted, however, are normally in a range of 1,000 to 30,000 rpm. The desirable range of revolutions per minute is 5,000 to 20,000 rpm. The dispersing time is not restricted particularly. However, in a case of batch dispersion, the dispersing time is normally in a range of 0.1 minute to 5 minutes. The temperature during dispersion is normally in a range of 0° C. to 150° C. and the desirable range of temperature is 40° C. to 98° C.

3) While preparing an emulsified liquid, amine (B) is added and a polyaddition reaction is allowed to take place with a polyester prepolymer (A) having an isocyanate group.

This reaction is also called an extension reaction of extension of a molecular chain. The reaction time is selected according to the reactivity of an amine (B) with a structure of an isocyanate group of the polyester prepolymer (A) and is normally in a range of 10 minutes to 40 hours. The desirable reaction time is in a range of 2 hours to 24 hours. The reaction temperature is normally in a range of 0° C. to 150° C. and the desirable range of temperature is from 40° C. to 98° C. Moreover, a known catalyst can be used according to necessity. Concrete examples of the catalyst are dibutyl tin laurate and dioctyl tin laurate.

4) On completion of the reaction, the organic solvent is removed from the emulsified dispersing element (reaction compound), washed, and dried to obtain the host particles of the toner.

To remove the organic solvent, the whole system is heated up while laminar flow stirring. Around a particular temperature the mixture is stirred vigorously and then the fusiform host particles of the toner are prepared by carrying out diliquoring. Further, if a compound like calcium phosphate salt, that dissolves in an acid or an alkali is used an a dispersion stabilizer, after the calcium phosphate salt is dissolved in an acid like hydrochloric acid, the calcium phosphate salt is removed from the host particles of the toner according to a method of cleaning.

5) A charge controlling agent is penetrated into the host particles of toner thus obtained, and inorganic fine particles like those of silica, titanium oxide etc. are added externally to obtain the toner. The penetrating of the charge controlling agent and the addition of the inorganic fine particles are carried out by a known method using a mixer etc.

Thus, a toner having a sharp particle size distribution and with a small particle size can be obtained easily. Moreover, by vigorous stirring for removing the organic solvent, the size of particles between perfectly spherical and rugby ball size can be controlled. Furthermore, the morphology of the surface can also be controlled between the smooth and the rough.

Particularly, for the toner used in the image forming unit 100 in the present invention, the surface is made harder than the inner side. In a toner, that is dry pulverized after melting and kneading, it is difficult to adjust the hardness of the toner such that it is in increasing or decreasing order from the center to the surface of the particle. However, in a wet polymerized toner that is polymerized in the solvent in the present invention, the structure in which the hardness of the toner is in increasing or decreasing order from the center to the surface of the particle can be imparted easily.

The desirable volume average particle size of this toner is in a range of 3 micrometers to 10 micrometers. Smaller is the particle size, better is the reproducibility of thin lines and a good image quality can be achieved. If the volume average particle size is smaller than 3 micrometers, the forming of liquid drops becomes difficult and if the volume average particle size is bigger than 10 micrometers, the toner prepared by dry pulverization becomes cost effective. Moreover, regarding the particle size distribution, it is desirable that the ratio (Dv/Dn) of the volume average particle size (Dv) and the number average particle size (Dn) is in a range of 1.05 to 1.40. Sharpening the particle size distribution results in making the charging distribution uniform, thereby enabling to achieve a high quality image having reduced excessive concentration of toner at a particular point on the surface of a paper. Furthermore, the ratio of transferring can be improved. The ratio Dv/Dn of less than 1.05 is difficult from the manufacturing point of view and a ratio of more than 1.40 results in widening of the charging distribution, thereby not enabling to achieve a high quality image.

The toner has a degree of circularity such that the shape factor SF-1 is in a range of 100 to 180 and the shape factor SF-2 is in a range of 100 to 190.

Figure 6A:
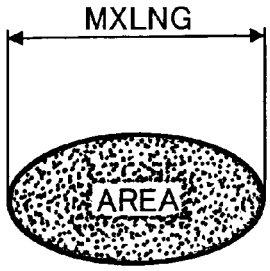
FIG. 6A and FIG. 6B illustrate shape factors.
Figure 6B:
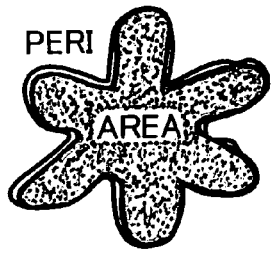

FIG. 6 is a schematic representation of the toner shape for explaining the shape factor SF-1 and the shape factor SF-2. The shape factor SF-1 indicates the proportion of circularity of the toner particle and is represented by the following formula (3). The square of the maximum length MXLNG of the shape obtained by projecting the toner in a two dimensional plane, is divided by the graphic area AREA and is then multiplied by 100π/4 to obtain the value of the shape factor SF-1.

$$SF\text{-}1=\{(MXLNG)2/\mathrm{AREA}\}\times(100\pi/4) \quad (3)$$

When the value of SF-1 is equal to 100, the shape of the toner is perfectly circular and as the value of SF-1 increases, the shape goes on becoming indefinite.

The shape factor SF-2 is a proportion of surface unevenness of the toner and is represented by the following formula. The square of the periphery PERI of the shape obtained by projecting the toner in two-dimensional plane, is divided by the graphic area AREA and is then multiplied by 100π/4 to obtain the value of the shape factor SF-1.

$$SF\text{-}2=\{(PERI)2/\mathrm{AREA}\}\times(100\pi/4) \quad (4)$$

When the value of SF-2 is equal to 100, there is no unevenness on the surface of the toner and as the value of SF-2 decreases, the surface unevenness of the toner goes on becoming remarkable.

The shape factor was measured by taking a picture of the toner with a scanning electron microscope (S-800 manufactured by HITACHI SEISAKUSHO), analyzing it with an image analyzer (LUSEX 3 manufactured by NIRECO CO., LTD.), and calculating the shape factor.

When the shape of the toner particles is closer to the circular shape, the contact of the toner particle with the other toner particle or the contact of the toner particle with an image carrier 1 is a point contact, which improves the fluidity of the toner. Thus, the mutual adhesion is deteriorated, the fluidity is improved thereby improving the transferring rate. However, due to deterioration of the adhesion power, the toner particles enter the gap between a cleaning blade 9A and the image carrier 1 and the cleaning blade 9A can pass easily over the toner particles. Therefore, it is better to have the shape factors SF-1 and SF-2 greater than 100. Furthermore, as the shape factors SF-1 and SF-3 increase, the toner is scattered on the image, thereby deteriorating the image quality. For this reason, it is advisable not to have the shape factor SF-1 greater than 180 and the shape factor SF-2 greater than 190.

In such a wet polymerization method, the mold releasing agent is not exposed on the surface of the toner particles. It is inside the toner particles and can be dispersed with priority near to the surface of the toner particles. Particularly, it is desirable that the proportion of area occupied the mold releasing agent in the region within 1 micrometer from the surface of the toner particles is in a range of 5 percent to 40 percent. Due to this, the softening point is lowered and the soft mold releasing agent is changed to the magnetic carrier, thereby allowing the life of the developer to last longer by not hindering the charging of the toner.

The magnetic material used in the carrier is a ferrite including a bivalent metal like iron, magnetite, Mn, Zn, Cu etc. with a desirable volume average particle size in a range of 20 micrometers to 100 micrometers. If the average particle size is smaller than 20 micrometers, the carrier is easily adhered to the photosensitive drum 1 during developing and if the average particle size is bigger than 100 micrometers, the magnetic material doesn't mix well with the toner and the toner is not sufficiently charged, thereby causing defective charging during continuous use. Although it is desirable that the a copper ferrite that includes zinc is used as the magnetic material due to its high saturation magnetization, a suitable magnetic material can be selected according to the process of the image forming apparatus 100. The resins that coat the magnetic carrier are not restricted to any particular resins, and silicone resins, styrene-acrylic resins, fluorine resins, olefin resins are the examples. In the method of manufacturing, the coating resin is dissolved in a solvent, sprayed in the fluid bed, and then coated on the core. In another method of manufacturing, the resin particles are adhered to the nucleons electrostatically and then coated by thermal melting. The thickness of the coated resin is in a range of 0.05 micrometers to 10 micrometers and the desirable range of thickness is from 0.3 micrometers to 4 micrometers.

Figure 7A:
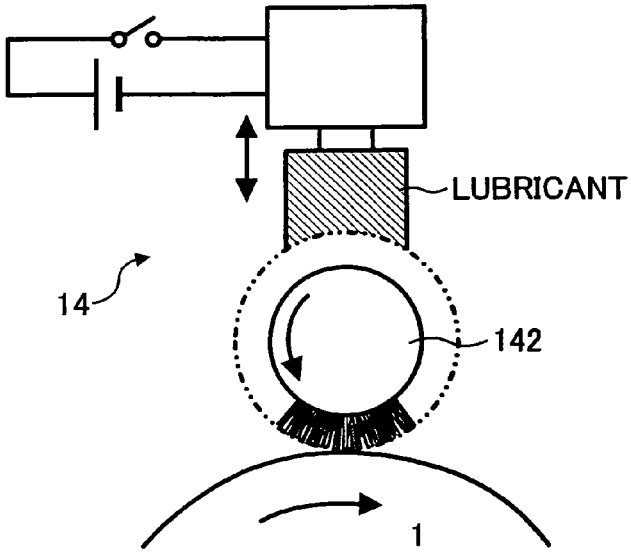
FIG. 7A and FIG. 7B are schematic diagrams of a lubricating unit in the image forming apparatus according to the first embodiment.
Figure 7B:
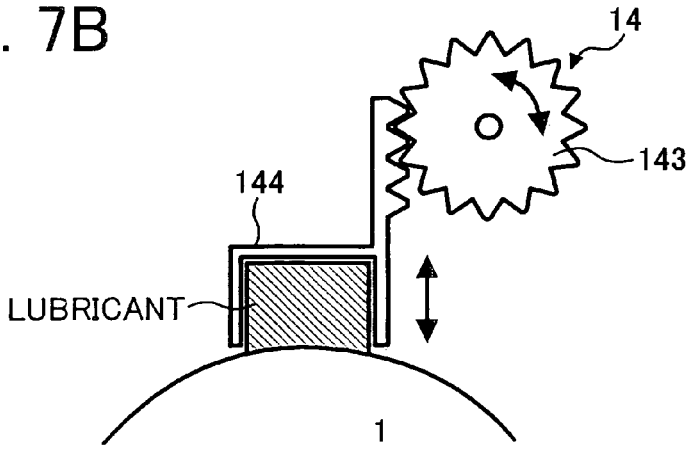

A lubricating unit for applying a lubricant can be installed in the image forming unit 100 in the present invention. FIG. 7A and FIG. 7B are enlarged schematic views of a lubricating unit 14 in the image forming apparatus 100. A lubricant in solid form is fitted to a solenoid 141 as shown in FIG. 7A. This solid lubricant is in contact with a brush 142 and is applied on the surface of the photosensitive drum 1 through the brush 142. The solenoid 141 is put ON and OFF according to a signal from a control section and varies application of the solid lubricant on the photosensitive drum. The application of the lubricant on the photosensitive drum can be adjusted by varying the quantity to be applied by changing the linear speed ratio of the brush with respect to the photosensitive drum. A lubricant in solid form is fitted to a holder 144 and performs up and down movement by rotation of a gear 143 thereby adjusting the quantity of the lubricant to be applied. The gear 143 is driven by a stepping motor and the quantity of the lubricant to be applied is varied due to variation in pressure between the photosensitive drum and the solid lubricant.

The typical examples of lubricant are given below. However, the lubricant to be used is not restricted only to these examples. The examples are metal salts of fatty acids like lead oleate, zinc oleate, copper oleate, zinc stearate, cobalt stearate, iron stearate, copper stearate, zinc palmitate, copper palmitate, and zinc linoleate or fluorine resin particles. The fluorine resin particles are desirable as lubricant and polytetrafluoroethylene (PTFE) is more desirable.

Thus in the cleaning unit in the present embodiment, since the loss tangent tan δ of the cleaning blade is not more than 1 and the temperature peak is not more than 2° C., the bending of the blade, the resonance and chattering due to the vibrations of the cleaning blade, can be suppressed. Further, by reducing the inclination of the loss tangent tan δ with respect to the temperature in the practical temperature range that is used, the bending of the cleaning blade, the resonance and chattering due to the vibrations of the blade can be suppressed even in the environmental conditions of high and low temperatures.

In the process cartridge according to the first embodiment, even in the environmental conditions of high temperature and low temperature, the cleaning defects can be minimized by suppressing the bending of the cleaning blade, the resonance and chattering due to the vibrations of the cleaning blade, thereby making the life of the process cartridge longer.

In the image forming apparatus in the present invention, even in the environmental conditions of high and low temperatures, the cleaning defects can be minimized by suppressing the bending of the cleaning blade, the resonance and chattering due to the vibrations of the cleaning blade, thereby enabling to achieve a high quality image without any defect like white patch etc. Moreover, an image having high reproducibility of thin lines and high transferring rate can be achieved by using a wet polymerized toner having a small particle size and spherical shaped particles.

Modification

Figure 8:
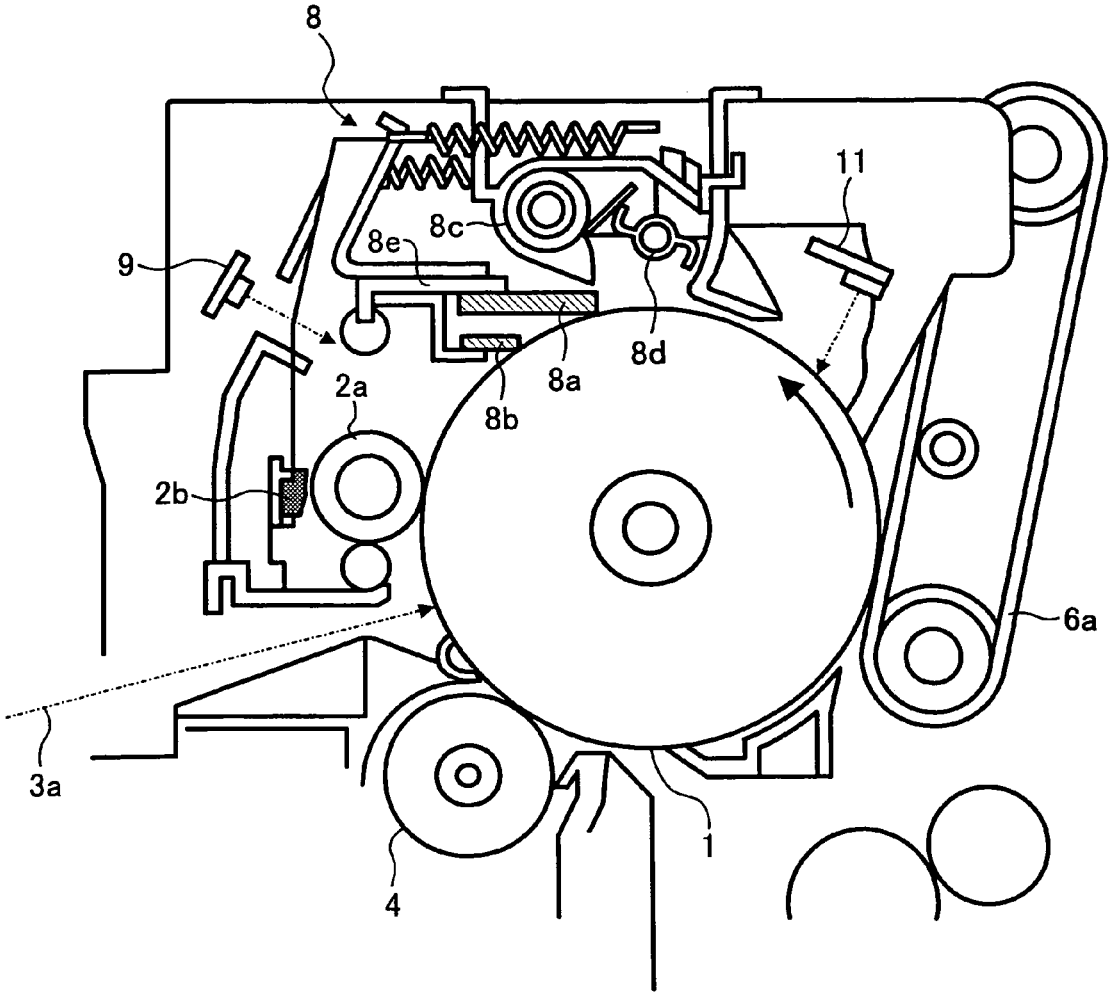
FIG. 8 is a schematic diagram of a cleaning unit equipped with two cleaning blades used in the image forming apparatus according to the first embodiment.

A cleaning unit having two cleaning blades can be installed in the image forming apparatus 100 in the present invention. FIG. 8 is schematic diagram of the cleaning unit equipped with two cleaning blades. Two cleaning blades 8*a* and 8*b* may be disposed in either a counter form (directed against the direction of rotation of the photosensitive drum) or a trailer form (directed in the direction of rotation of the photosensitive drum). Although the two cleaning blades are in the same cleaning unit, they may be disposed in different positions.

A structure of an image forming apparatus according to a second embodiment of the present invention, which is equipped with a cleaning unit, and a structure around the periphery of a photosensitive drum of the image forming apparatus are similar to those in the first embodiment. A charging unit 2, an exposing unit 3, a developing unit 4, a transferring unit 6, a fixing unit 7, and a cleaning unit 8 are disposed around an electrostatic latent image carrier, i.e. a photoconductor 1.

A cleaning blade 8*a* in the cleaning unit in the present embodiment has impact resilience not less than 35 percent at 10° C. and a rate of change of the impact resilience in a temperature range of 10° C. to 40° C. is not more than 1.4/° C.

The cleaning blade 8*a* has to be elastic such that the blade follows satisfactorily according to the movement of the photosensitive drum and the toner on the photosensitive drum 1 can be scraped without getting slipped through the gap between the cleaning blade 8*a* and the photosensitive drum. If the value of the impact resilience is greater, the blade follows the movement of the photosensitive drum satisfactorily and the toner cannot slip through easily. Upon examining the temperature dependency of impact resilience of the elastic material based on the method for testing of impact resilience, the impact resilience was observed to be low at a low temperature and increased with the increase in temperature. In a temperature range of 10° C. to 40° C., which is a normal temperature range for the use of the image forming apparatus, it is desirable to have the impact resilience above certain value. For the cleaning blade 8*a* in the present invention, the impact resilience at the minimum temperature of 10° C. is regulated to be not less than 35 percent. If the impact resilience is less than 35 percent, the cleaning blade 8*a* is almost rigid and doesn't follow the movement of the photosensitive drum 1 satisfactorily, thereby affecting the scraping of the toner. This may cause defective cleaning, particularly during the operation of the image forming apparatus at a low temperature.

If a toner having a small particle size and spherical particles is used as a developer, since it is difficult to clean this type of toner with the blade, the value of the impact resilience of the cleaning blade 8*a* is even more important. It is desirable to use a cleaning blade having the impact resilience not less than 38 percent at 10° C. as the cleaning blade 8*a* for cleaning the toner having a small particle size and spherical particles. This allows more flexibility of cleaning during the operation at a low temperature.

Further, the rate of change of the impact resilience in a temperature range of 10° C. to 40° C. is not greater than 1.4/° C. In a temperature range of 10° C. to 40° C., i.e. in a normal temperature range of using the image forming apparatus, smaller the rate of change of the impact resilience of the cleaning blade 8*a*, there is no effect due to change in the temperature. Therefore, the angle of the tip of the cleaning blade 8*a* that is in contact with the photosensitive drum can be maintained to be constant and good cleaning can be maintained. If the rate of change of the impact resilience is greater than 1.4/° C. and if the value of the impact resilience becomes too high on the higher temperature side, it causes bending of the blade leading to the defective cleaning.

The elastic material used in the cleaning blade 8*a* is similar to that explained in the first embodiment.

Figure 9:
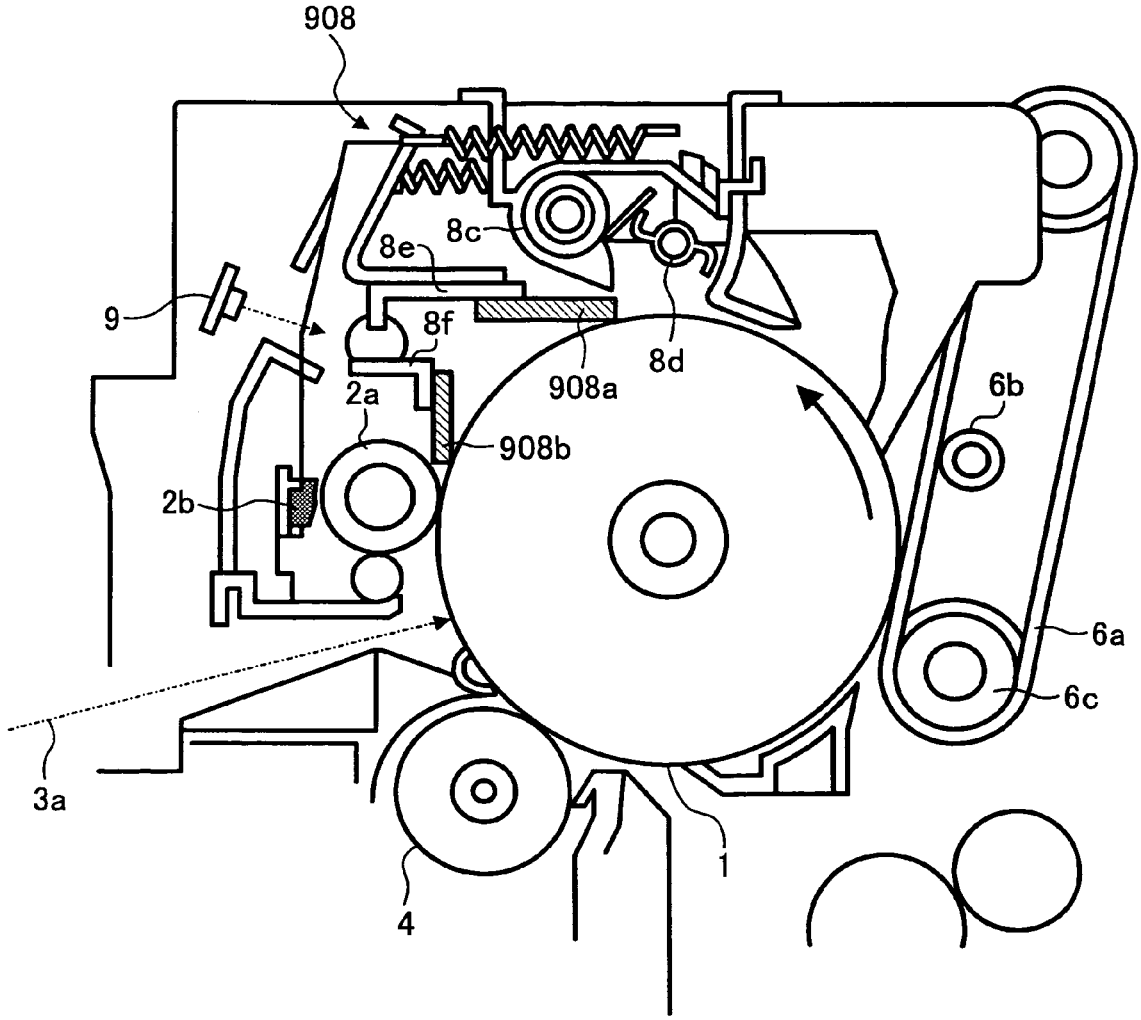
FIG. 9 is a schematic diagram of a modification of the cleaning unit according to the second embodiment.

FIG. 9 is an illustration of another embodiment of the cleaning unit in the present invention. A cleaning unit 908 is equipped with a first cleaning blade 908*a* and a second cleaning blade 908*b*. At least the first cleaning blade 908*a* that is disposed in an upstream side of the rotation of a photosensitive drum 1 is having an impact resilience such that the rate of change of the impact resilience in a temperature range of 10° C. to 40° C. is not more than 1.4/° C. When a toner having a small particle size and spherical particles is used as a developer, due to the properties that make the cleaning by the blade difficult as mentioned earlier, use of two cleaning blades is effective as mentioned in the present embodiment. The toner and paper dust on the photosensitive drum 1, that could not be cleaned and removed by the first cleaning blade 908*a* are cleaned and removed by the second cleaning blade 908*b*.

It is more desirable that both of the first cleaning blade 908*a* and the second cleaning blade 908*b* are having the impact resilience such that the rate of change of the impact resilience in a temperature range of 10° C. to 40° C. is not more than 1.4/° C. Even the toner having a small particle size and spherical particles can be cleaned without any defect even during the operation at a low temperature. Thus, the cleaning unit 908 that is not affected by the change in temperature can be provided.

Both the first cleaning blade 908*a* and the second cleaning blade 908*b* are in contact with the photosensitive drum 1. It is desirable that the first cleaning blade 908*a* is disposed in a counter form (directed against the direction of rotation of the photosensitive drum) and the second cleaning blade 908*b* is disposed in a trailer form (directed in the direction of rotation of the photosensitive drum). Disposing of the first cleaning blade 908*a* in the counter form enables the removal of the toner and the paper dust remained on the photosensitive drum 1 effectively. Since the second cleaning blade 908*b* is provided in a downstream side of rotation of the photosensitive drum from the first cleaning blade 908*a*, the toner input is less and the blade may bend easily. This is prohibited by allowing the contact of the photosensitive drum 1 in a trailer form (directed in the direction of rotation of the photosensitive drum), thereby maintaining the cleaning performance over a long period of time.

It is desirable that the angle of contact of the first cleaning blade 908*a* with the photosensitive drum 1 from the position of a contact line is in a range of 5 degrees to 25 degrees. It is desirable that the contact pressure of the first cleaning blade 908*a* and the second cleaning blade 908*b* is a range of 10 gf/cm to 60 gf/cm as mentioned earlier.

It is desirable that the first cleaning blade 908*a* and the second cleaning blade 908*b* are supported by independent supports 8*e* and 8*f*. This is to prevent any mutual interference between the vibrations in the cleaning blades caused due to the friction with the photosensitive drum 1, particularly, to prevent any cleaning defect that is caused due to mutual interference of vibrations caused due to the low impact resilience at low temperature.

The positional relationship between the cleaning unit 908 and a decharging lamp 9 is such that either of the two may be in upstream side of the direction of rotation of the photosensitive drum 1. The second cleaning blade 908*b* in the cleaning unit 908 can be disposed in a downstream side of the direction of rotation of the photosensitive drum 1 from the first cleaning blade 908*a* with the charging lamp between the first cleaning blade and the second cleaning blade. In this case, it is desirable that the position of the second cleaning blade 908*b* is in upstream side from a charging roller 2*a*. The material remained on the surface of the photosensitive drum 1 after being cleaned by the first cleaning blade includes materials that are firmly adhered electrically on the surface of the photosensitive drum like inversely charged toner. For this reason, before the toner reaches the second cleaning blade 908*b*, the decharging lamp 9 eliminates the electric charge in the toner and the second cleaning blade 908*b* cleans the toner even more efficiently.

The cleaning unit in the present invention may be installed in the process cartridge. The process cartridge in the present invention supports integrally at least the cleaning unit 8 and the photosensitive drum 1 that eliminates the materials like toner remained on the photosensitive drum 1. The process cartridge is detachable from the image forming apparatus. The cleaning blade 8*a* in the cleaning unit 8 has sufficient impact resilience even at a low temperature and follows the movement of the photosensitive drum satisfactorily thereby cleaning the surface of the photosensitive drum without any slipping of the toner. Moreover, the rate of change of the impact resilience in a temperature range of 10° C. to 40° C., which is a normal temperature range in which the image forming apparatus is used, is low. Therefore, the angle of the tip of the cleaning blade 8*a* in contact with the photosensitive drum 1 can be maintained constant irrespective of the change in temperature and stable cleaning can be achieved.

The image forming apparatus equipped with the cleaning unit 8 in the present invention is not restricted only to the structure shown in FIG. 1. Other structures like a structure having an intermediate transfer element to which the toner image on the photosensitive drum 1 is transferred and carried, a structure having a plurality of photosensitive drums to form a multicolored image, are also possible. Further, the cleaning unit of the photosensitive drum 1 is not restricted to the cleaning units shown in FIG. 1, FIG. 2, and FIG. 9. A cleaning unit having the transfer belt 6*a* or an intermediate transfer element not shown in the figures is also possible.

Particularly, in the image forming apparatus in the present invention in which the installing of cleaning unit proves to be very effective, the toner used in the developing unit 4 is having a volume average particle size in a range of 3 micrometers to 8 micrometers. The particles of the toner are small in size and are in a range of 1.00 to 1.40 of ratio (Dv/Dn) of the volume average particle size (Dv) and the number average particle size (Dn) and the particle size distribution is narrow. By narrowing the particle size distribution, the charging distribution of the toner becomes uniform and it is possible to achieve a high quality image with less excessive concentration of toner at a particular point on the paper and to have a higher transferring rate. So far, it was difficult to clean such toner having a small particle size with blade cleaning and overcoming the adhesive power of the toner on the photosensitive drum. However, by installing the cleaning unit 8 in the present invention, the toner can be cleaned satisfactorily with a blade having regulated impact resilience. Further, slipping through of the toner at a low temperature can also be prohibited.

Installing the cleaning unit 8 in the present invention proves to be effective even when the toner having spherical particles is used in the developing unit. The toner having the spherical particles enters easily into the gap between the cleaning blade and the photosensitive drum and hence cannot be easily cleaned. However, due to the cleaning unit 8 in the present invention, the cleaning blade 8*a* follows the movement of the photosensitive drum 1 satisfactorily thereby allowing to clean the photosensitive drum. It is also possible to maintain satisfactory cleaning even under low temperature conditions.

The toner having the spherical particles can be regulated by the following values of the shape factors SF-1 and SF-2. For the image forming apparatus in the present invention, the shape factor SF-1 of the toner particles is in a range of 100 to 180 and the shape factor SF-2 of the toner particles is in a range of 100 to 180. The shape factors SF-1 and SF-2 in this case are as explained in the first embodiment while referring to FIG. 6.

The toner suitable to the image forming apparatus in the present invention is prepared by allowing to disperse a toner material solution consisting of at least a polyester prepolymer having a functional group that includes nitrogen atoms, a polyester, a colorant, and a mold releasing agent, in an organic solvent and then allowing to undergo a cross linking reaction and an extension reaction in an aqueous medium.

The composition and the method for preparation of the toner to be used in the image forming apparatus in the present invention is similar to that of the toner explained in the first embodiment.

The toner prepared by following this method can be used as a one component magnetic toner not using a magnetic carrier or as a non-magnetic toner.

Moreover, when this toner is used in the two-component developer, it is better to mix it with a magnetic carrier. It is desirable that the magnetic carrier is a ferrite including a bivalent metal like iron, magnetite, Mn, Zn, Cu and the volume average particle size is in a range of 20 micrometers to 100 micrometers. If the average particle size is smaller than 20 micrometers, the carrier may adhere easily to the photosensitive drum 1 during developing and if the particle size is bigger than 100 micrometers, the mixing with the toner is not good and the toner is not charged sufficiently thereby causing charging defect easily during the continuous use. Further, although the ferrite of Cu that includes Zn is desirable due to its high saturation magnetization, it can be selected according to the process of the image forming apparatus 100. The resins that coat the magnetic carrier are not restricted and resins like silicone resins, styrene-acrylic resins, fluorine contained resins, olefin resins can be used. In the method of manufacturing, the coating resin is dissolved in a solvent, sprayed in the fluid bed, and then coated on the core. In another method of manufacturing, the resin particles are adhered to the nucleons electrostatically and then coated by thermal melting. The thickness of the coated resin is in a range of 0.05 micrometers to 10 micrometers and the desirable range of thickness is from 0.3 micrometers to 4 micrometers.

Thus, according to the present embodiment, by providing the cleaning blade that has good cleaning performance at a low temperature and there is no effect on cleaning even with the change in environmental conditions, it is possible to provide a suitable cleaning unit for cleaning of the toner having particles of smaller size and spherical particles. Thus by installing such cleaning unit, due to an excellent cleaning performance, it is possible to form a good quality image over a period of long time without any image defect. Moreover, it is possible to provide a toner that can be used in this image forming apparatus and can form a highly defined image.

The present document incorporates by reference the entire contents of Japanese priority documents, 2002-276748 filed in Japan on Sep. 24, 2002 and 2002-314241 filed in Japan on Oct. 29, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning unit comprising:

a cleaning blade that cleans a surface of a photosensitive drum, wherein when a sine-wave vibration of 10 Hz is applied to the cleaning blade, a peak temperature of a loss tangent tan δ is in a range of −1° C. to −30° C.

2. The cleaning unit according to claim 1, wherein the cleaning blade is made of thermosetting urethane elastomer.

3. The cleaning unit according to claim 2, wherein static friction coefficient of the surface of the photosensitive drum is in a range of 0.1 to 0.4.

4. The cleaning unit according to claim 3, wherein the photosensitive drum includes a surface layer that contains a fluorine-contained resin particle.

5. A cleaning unit comprising:

a cleaning blade that cleans a surface of a photosensitive drum, wherein when a sine-wave vibration of 10 Hz is applied to the cleaning blade, a peak temperature of a loss tangent tan δ is in a range of 2° C. to −30° C., wherein when the sine-wave vibration of 10 Hz is applied to the cleaning blade, a temperature-dependent change of the loss tangent tan δ in a temperature range of 10° C. to 40° C. is in a range of 0.001/° C. to 0.020/° C.

6. A process cartridge comprising:

an arrangement that includes at least a cleaning unit that cleans residual toner on a photosensitive drum, and that is detachably mounted on an image forming apparatus, wherein the cleaning unit includes a cleaning blade that is in contact with a surface of the photosensitive drum to clean the surface, and when a sine-wave vibration of 10 Hz is applied to the cleaning blade, a peak temperature of a loss tangent tan δ is in a range of −1° C. to −30° C.

7. The process cartridge according to claim 6, wherein the cleaning blade is made of thermosetting urethane elastomer.

8. The process cartridge according to claim 7, wherein the coefficient of static friction of the surface of the photosensitive drum is in a range of 0.1 to 0.4.

9. The process cartridge according to claim 8, the photosensitive drum includes a surface layer that contains a fluorine-contained resin particle.

10. A process cartridge comprising:

an arrangement that includes at least a cleaning unit that cleans residual toner on a photosensitive drum, and that is detachably mounted on an image forming apparatus, wherein the cleaning unit includes a cleaning blade that is in contact with a surface of the photosensitive drum to clean the surface, and when a sine-wave vibration of 10 Hz is applied to the cleaning blade, a peak temperature of a loss tangent tan δ is in a range of 2° C. to −30° C., wherein when the sine-wave vibration of 10 Hz is applied to the cleaning blade, a temperature-dependent change of the loss tangent tan δ in a temperature range of 10° C. to 40° C., is in a range of 0.001/° C. to 0.020/° C.

11. An image forming apparatus comprising:

a photosensitive drum on which an electrostatic latent image is formed;

a charging unit that charges the photosensitive drum;

an exposing unit that exposes a surface of the photosensitive drum to form the electrostatic latent image;

a developing unit that supplies toner to the surface of the photosensitive drum to form a toner image;

a transferring unit that includes either of a transferring member and an intermediate transfer element to transfer the toner image to a recording medium; and a cleaning unit that includes a cleaning blade that cleans the surface of the photosensitive drum, wherein when a sine-wave vibration of 10 Hz is applied to the cleaning blade, a peak temperature of a loss tangent tan δ is in a range of −1° C. to −30° C.

12. The image forming apparatus according to claim 11, wherein the cleaning blade is made of thermosetting urethane elastomer.

13. The image forming apparatus according to claim 12, wherein static friction coefficient of the surface of the photosensitive drum is in a range of 0.1 to 0.4.

14. The image forming apparatus according to claim 13, wherein the photosensitive drum includes a surface layer that contains a fluorine-contained resin particle.

15. The image forming apparatus according to claim 11, wherein the toner is made by melting and kneading a mixture of at least a binder resin, a colorant, and a mold releasing agent, then pulverizing and classifying the mixture, and a volume average particle size of the toner is in a range of 3 micrometers to 8 micrometers.

16. The image forming apparatus according to claim 15, wherein the binder resin is a prepolymer of a polyester having a functional group that contains a nitrogen atom, the toner is made by dispersing the mixture in an aqueous medium in presence of fine particles of resin, then allowing to undergo polyaddition reaction followed by drying and classifying the dispersed mixture, and a volume average particle size of the toner is in a range of 3 micrometers to 8 micrometers.

17. The image forming apparatus according to claim 11, wherein a ratio of the volume average particle size and a number average particle size of the toner Dv/Dn is in a range of 1.05 to 1.80.

18. The image forming apparatus according to claim 11, wherein a shape factor SF-1 of the toner is in a range of 100 to 180, and a shape factor SF-2 of the toner is in a range of 100 to 190.

19. The image forming apparatus according to claim 11, wherein a fluorine-contained resin is added externally as an additive to the toner.

20. The image forming apparatus according to claim 11, further comprising:

an applying unit that applies fluorine-contained resin on the photosensitive drum.

21. The image forming apparatus according to claim 11, wherein the cleaning unit includes at least two cleaning blades.

22. An image forming apparatus comprising:

a photosensitive drum on which an electrostatic latent image is formed;

a charging unit that charges the photosensitive drum;

an exposing unit that exposes a surface of the photosensitive drum to form the electrostatic latent image;

a developing unit that supplies toner to the surface of the photosensitive drum to form a toner image;

a transferring unit that includes either of a transferring member and an intermediate transfer element to transfer the toner image to a recording medium; and a cleaning unit that includes a cleaning blade that cleans the surface of the photosensitive drum, wherein when a sine-wave vibration of 10 Hz is applied to the cleaning blade, a peak temperature of a loss tangent tan δ is in a range of 2° C. to −30° C., wherein when the sine-wave vibration of 10 Hz is applied to the cleaning blade, a temperature-dependent change of the loss tangent tan δ in a temperature range of 10° C. to 40° C. is in a range of 0.001/° C. to 0.020/° C.

23. A cleaning unit comprising:

a cleaning blade that cleans a surface of a photosensitive drum, wherein an impact resilience of the cleaning blade at 10° C. is equal to or more than 35 percent, and a rate of change of the impact resilience in a temperature range of 10° C. to 40° C. is equal to or less than 1.4/° C.

24. The cleaning unit according to claim 23, wherein the cleaning blade is made of a urethane elastomer.

25. The cleaning unit according to claim 23, further comprising a downstream cleaning blade that is disposed at a downstream of rotation of the photosensitive drum than the cleaning blade.

26. The cleaning unit according to claim 25, wherein the cleaning blade is disposed in a counter form, and the downstream cleaning blade is disposed in a trailer form.

27. The cleaning unit according to claim 25, wherein each of the cleaning blade and the downstream cleaning blade is supported by an independent supporting element.

28. A process cartridge comprising:

an arrangement that includes at least a cleaning unit that cleans residual toner on a photosensitive drum, and that is detachably mounted on an image forming apparatus, wherein the cleaning unit includes a cleaning blade that is in contact with a surface of the photosensitive drum to clean the surface, an impact resilience of the cleaning blade at 10° C. is equal to or more than 35 percent, and a rate of change of the impact resilience in a temperature range of 10° C. to 40° C. is equal to or less than 1.4/° C.

29. The process cartridge according to claim 28, wherein the cleaning blade is made of a urethane elastomer.

30. The process cartridge according to claim 28, further comprising a downstream cleaning blade that is disposed at a downstream of rotation of the photosensitive drum than the cleaning blade.

31. The process cartridge according to claim 30, wherein the cleaning blade is disposed in a counter form, and the downstream cleaning blade is disposed in a trailer form.

32. The cleaning unit according to claim 30, wherein each of the cleaning blade and the downstream cleaning blade is supported by an independent supporting element.

33. An image forming apparatus comprising:

a photosensitive drum on which an electrostatic latent image is formed;

a charging unit that charges the photosensitive drum;

an exposing unit that exposes a surface of the photosensitive drum to form the electrostatic latent image;

a developing unit that supplies toner to the surface of the photosensitive drum to form a toner image;

a transferring unit that has either a transferring member or an intermediate transfer element, and transfers the toner image to a surface of a recording medium; and a cleaning unit that includes a cleaning blade that cleans the surface of the photosensitive drum, wherein an impact resilience of the cleaning blade at 10° C. is equal to or more than 35 percent, and a rate of change of the impact resilience in a temperature range of 10° C. to 40° C. is equal to or less than 1.4/° C.

34. The image forming apparatus according to claim 33, wherein the cleaning blade is made of a urethane elastomer.

35. The image forming apparatus according to claim 33, further comprising a downstream cleaning blade that is disposed at a downstream of rotation of the photosensitive drum than the cleaning blade.

36. The image forming apparatus according to claim 35, wherein the cleaning blade is disposed in a counter form, and the downstream cleaning blade is disposed in a trailer form.

37. The image forming apparatus according to claim 35, wherein each of the cleaning blade and the downstream cleaning blade is supported by an independent supporting element.

38. The image forming apparatus according to claim 35, further comprising a decharging unit that decharges the surface of the photosensitive drum after transferring the toner image, wherein the downstream cleaning blade is disposed at the downstream of rotation of the photosensitive drum with respect to the cleaning blade with the decharging unit disposed between the cleaning blade and the downstream cleaning blade.

39. The image forming apparatus according to claim 38, wherein the downstream cleaning blade is disposed at an upper stream side of rotation of the photosensitive drum than the charging unit.

40. The image forming apparatus according to claim 33, wherein a volume average particle size of the toner is in a range of 3 micrometers to 8 micrometers, and a ratio of the volume average particle size and a number average particle size of the toner Dv/Dn is in a range of 1.00 to 1.4.

41. The image forming apparatus according to claim 33, wherein a shape factor SF-1 of the toner is in a range of 100 to 180, and a shape factor SF-2 of the toner is in a range of 100 to 180.

42. The image forming apparatus according to claim 33, wherein the toner is made by allowing a toner solution to undergo at least either of a cross linking reaction and an extension reaction in an aqueous medium, wherein the toner solution is made by dispersing a mixture of at least a prepolymer of a polyester having a functional group that includes a nitrogen atom, a mold releasing agent, a colorant, and a polyester, in an organic solvent.

* * * * *